United States Patent [19]

Iino et al.

[11] Patent Number: 4,863,821

[45] Date of Patent: Sep. 5, 1989

[54] PHOTOSENSITIVE MEMBER COMPRISING CHARGE GENERATING LAYER AND CHARGE TRANSPORTING LAYER HAVING AMORPHOUS CARBON

[75] Inventors: Shuji Iino, Hirakata; Hotomi Hideo, Suita; Isao Doi, Toyonaka; Mitsutoshi Nakamura, Osaka; Izumi Osawa, Ikeda, all of Japan

[73] Assignee: Minolta Camera Kabushiki Kaisha, Osaka, Japan

[21] Appl. No.: 69,420

[22] Filed: Jul. 2, 1987

[30] Foreign Application Priority Data

| | | | |
|---|---|---|---|
| Jul. 7, 1986 | [JP] | Japan | 61-159214 |
| Jul. 7, 1986 | [JP] | Japan | 61-159215 |
| Jul. 7, 1986 | [JP] | Japan | 61-159217 |
| Sep. 8, 1986 | [JP] | Japan | 61-210883 |
| Sep. 8, 1986 | [JP] | Japan | 61-210884 |

[51] Int. Cl.[4] ..... G03G 5/14; G03G 5/085

[52] U.S. Cl. ..... 430/58; 430/84

[58] Field of Search ..... 430/56, 58, 84, 95

[56] References Cited

U.S. PATENT DOCUMENTS

| | | | |
|---|---|---|---|
| 3,956,525 | 5/1976 | Yasuba . | |
| 4,366,208 | 12/1982 | Akai et al. . | |
| 4,376,688 | 3/1983 | Ceasar et al. . | |
| 4,416,755 | 11/1983 | Ceasar et al. . | |
| 4,490,450 | 12/1984 | Shimizu et al. . | |
| 4,495,262 | 1/1985 | Matsuzaki et al. . | |
| 4,510,224 | 4/1985 | Yamazaki et al. . | |
| 4,518,670 | 4/1985 | Matsuzaki et al. . | |
| 4,544,617 | 10/1985 | Mort et al. . | |
| 4,557,987 | 12/1985 | Shirai et al. . | |
| 4,579,801 | 4/1986 | Yashiki . | |
| 4,634,648 | 1/1987 | Jansen et al. | 430/95 |
| 4,720,444 | 1/1988 | Chen | 430/58 |
| 4,749,637 | 6/1988 | Hayashida et al. | 430/58 |

FOREIGN PATENT DOCUMENTS

| | | |
|---|---|---|
| 50-30526 | 3/1975 | Japan . |
| 51-46130 | 4/1976 | Japan . |
| 54-115134 | 9/1979 | Japan . |
| 55-86169 | 6/1980 | Japan . |
| 56-60447 | 5/1981 | Japan . |
| 59-28161 | 2/1984 | Japan . |
| 59-38753 | 3/1984 | Japan . |
| 59-136742 | 8/1984 | Japan . |
| 59-214859 | 12/1984 | Japan . |
| 60-61761 | 4/1985 | Japan . |
| 61761 | 4/1985 | Japan . |
| 60-63541 | 4/1985 | Japan . |
| 61-94056 | 5/1986 | Japan . |
| 61-289355 | 12/1986 | Japan . |

OTHER PUBLICATIONS

Journal of Applied Polymer Science, vol. 17, 1973.

"A C-nmr Investigation of Plasma Polymerized Ethane, Ethylene, and Acetylene" Dilks et al., Journal of Polymer Science, vol. 19, 1981.

*Primary Examiner*—John L. Goodrow

*Attorney, Agent, or Firm*—Burns, Doane, Swecker & Mathis

[57] ABSTRACT

A photosensitive member of the present invention comprises an electrically conductive substrate, a charge generating layer and a charge transporting layer comprising amorphous carbon which contains hydrogen.

The charge transporting layer contains about 0.1 to about 25 atomic % of halogen based on all the constituent atoms therein, and in addition to halogen, oxygen and/or nitrogen may be contained in the charge transporting layer.

The photosensitive member of this construction is excellent in electrophotographic characteristics inclusive of charge tranportability and charging ability.

10 Claims, 3 Drawing Sheets

PHOTOSENSITIVE MEMBER COMPRISING CHARGE GENERATING LAYER AND CHARGE TRANSPORTING LAYER HAVING AMORPHOUS CARBON

BACKGROUND OF THE INVENTION

1. Field of the Invention

The present invention relates to a photosensitive member of the function-separated type comprising a hydrogen-containing amorphous silicon layer as a charge transporting layer.

1. Description of the Prior Art

Remarkable progress has been made in the application of electrophotographic techniques since the invention of the Carlson process. Various materials have also been developed for use in electrophotographic photosensitive members.

Conventional photoconductive materials chiefly include inorganic compounds such as amorphous selenium, selenium-arsenic, selenium-tellurium, zinc oxide, amorphous silicon and the like, and organic compounds such as polyvinylcarbazole, metal phthalocyanine, disazo pigments, tris-azo pigments, perillene pigments, triphenylmethanes, triphenylamines, hydrazones, styryl compounds, pyrazolines, oxazoles, oxadiazoles and the like. The structures of photosensitive members include, for example, those of the single-layer type wherein such a material is used singly, the binder type wherein the material is dispersed in a binder, and the function-separated type comprising a charge generating layer and a charge transporting layer.

However, conventional photoconductive materials have various drawbacks. For example, the above-mentioned inorganic materials except for amorphous silicon (a-Si) are harmful to the human body.

The electrophotographic photosensitive member, when employed in a copying apparatus, must always have stabilized characteristics even if it is subjected to the severe environmental conditions of charging, exposure, developing, image transfer, removal of residual charges and cleaning, whereas the foregoing organic compounds have poor durability and many unstable properties.

In order to eliminate these drawbacks, progress has been made in recent years in the application of a-Si formed by the glow discharge process to electrophotographic photosensitive members as a material with reduced harmfulness and higher durability. Nevertheless, a-Si is hazardous to manufacture since it requires highly ignitable silane gas as its starting material. Moreover, a-Si requires a large quantity of silane gas which is expensive, rendering the resulting photosensitive member exceedingly more costly than conventional photosensitive members. The manufacture of photosensitive members of a-Si involves many disadvantages. For example, a-Si is low in film-forming speed and releases a large amount of explosive undecomposed silane products in the form of particles when forming a film. Such particles, when incorporated into the photosensitive member being produced, give a seriously adverse influence on the quality of images to be obtained. Further a-Si has a low chargeability due to its original high relative dielectric constant. This necessitates the use of a charger of higher output for charging the a-Si photosensitive member to a predetermined surface potential in the copying apparatus.

On the other hand, it has been proposed in recent years to use plasma-polymerized organic films for photosensitive members.

Plasma-polymerized organic films per se have been well-known for a long time. In Journal of Applied Polymer Science, Vol. 17, pp. 885–892, 1973, for example, M. Shen and A. T. Bell state that a plasma-polymerized organic film can be produced from the gas of any organic compound. The same authors discuss film formation by plasma polymerization in "Plasma Polymerization," published by the American Chemical Society in 1979.

However, the plasma-polymerized organic films prepared by the conventional process have been used only as insulating films. They are thought to be insulating films having a specific resistivity of about $10^{16}$ ohm-cm like usual polyethylene films, or are used as recognized at least as such. The use of the film for electrophotographic photosensitive members is based also on the same concept; the film has found limited use only as an undercoat or overcoat serving solely as a protective layer, adhesion layer, blocking layer or insulating layer.

For example, Unexamined Japanese Patent Publication No. SHO 59-28161 discloses a photosensitive member which comprises a plasma-polymerized high polymer layer of reticular structure formed on a substrate and serving as a blocking-adhesion layer and an a-Si layer formed on the polymer layer. Unexamined Japanese Patent Publication No. SHO 59-38753 discloses a photosensitive member which comprises a plasma-polymerized film having a thickness of 10 to 100 angstroms and formed over a substrate as a blocking-adhesion layer, and an a-Si layer formed on the film, the plasma-polymerized film being prepared from a gas mixture of oxygen, nitrogen and a hydrocarbon and having a high resistivity of $10^{13}$ to $10^{15}$ ohm-cm. Unexamined Japanese Patent Publication No. SHO 59-136742 discloses a photosensitive member wherein an aluminum substrate is directly coated with a carbon film having a thickness of about 1 to about 5 μm and serving as a protective layer for preventing aluminum atoms from diffusing through an a-Si layer formed over the substrate when the member is exposed to light. Unexamined Japanese Patent Publication No. SHO 60-63541 discloses a photosensitive member wherein a diamond-like carbon film, 200 angstroms to 2 μm in thickness, is interposed between an aluminum substrate and an overlying a-Si layer to serve as an adhesion layer to improve the adhesion between the substrate and the a-Si layer. The publication says that the film thickness is preferably up to 2 μm in view of the residual charge.

These disclosed inventions are all directed to a so-called undercoat provided between the substrate and the a-Si layer. In fact, these publications mention nothing whatever about charge transporting properties, nor do they offer any solution to the foregoing substantial problems of a-Si.

Futhermore, U.S. Pat. No. 3,956,525, for example, discloses a photosensitive member of the polyvinylcarbazole-selenium type coated with a polymer film having a thickness of 0.1 to 1 μm and formed by glow discharge polymerization as a protective layer. Unexamined Japanese Patent Publication No. SHO 59-214859 discloses a technique for protecting the surface of an a-Si photosensitive member with an approximately 5-μm-thick film formed by plasma-polymerizing an organic hydrocarbon monomer such as styrene or acetylene. Unexamined Japanese Patent Publication No.

SHO 60-61761 discloses a photosensitive member having a diamond-like carbon thin film 500 angstroms to 2 μm in thickness and serving as a surface protective layer, it being preferred that the film thickness be up to 2 μm in view of transmittancy. Unexamined Japanese Patent Publication No. SHO 60-249115 discloses a technique for forming a film of amorphous carbon or hard carbon with a thickness of about 0.05 to about 5 μm for use as a surface protective layer. The publications states that the film adversely affects the activity of the protected photosensitive member when exceeding 5 μm in thickness.

These disclosed inventions are all directed to a so-called overcoat formed over the surface of the photosensitive member. The publications disclose nothing whatever about charge transporting properties, nor do they solve the aforementioned substantial problems of a-Si in any way.

Unexamined Japanese Patent Publication No. SHO 51-46130 discloses an electrophotographic photosensitive member of the polyvinylcarbazole type which has a polymer film 0.001 to 3 μm in thickness and formed on its surface by being subjected to glow discharge polymerization. Nevertheless, the publication is totally mute about charge transporting properties, further failing to solve the foregoing substantial problems of a-Si.

Thus, the conventional plasma-polymerized organic films for use in electrophotographic photosensitive members are used as undercoats or overcoats because of their insulating properties and need not have a carrier transporting function. Accordingly, the films used are limited in thickness to a very small value of up to about 5 μm at the most. Carriers pass through the film owing to a tunnel effect, while if the tunnel effect is not expectable, the film used has such a small thickness that will not pose problems actually as to the occurrence of a residual potential.

With electrophotographic photosensitive members of the function-separated type, the charge transporting layer must have high ability to transport carriers and needs to be at least $10^{-7}$ $cm^2/V/sec$ in carrier mobility. Further to be satisfactorily usable in electrophotographic systems, the charge transporting layer must have excellent charging characteristics and be capable of withstanding a voltage of 10 V/μm. It is also desired that the charge transporting layer have a specific dielectric constant of up to 6 to lessen the load on the charger.

SUMMARY OF THE INVENTION

In view of the foregoing problems, the main object of the present invention is to provide a photosensitive member which is generally excellent in electrophotographic characteristics and capable of giving satisfactory images.

Another object of the invention is to provide a photosensitive member which is excellent in charge transportability and in charging characteristics.

Another object of the invention is to provide a photosensitive member which is free of a reduction in sensitivity and of residual potential and which retains sensitivity with high stability despite lapse of time.

Another object of the invention is to provide a photosensitive member which is excellent in durability, weather resistance, resistance to environmental pollution and light transmitting property.

These and other objects of the invention can be fulfilled by providing a photosensitive member which comprises a substrate, a charge generating layer and a charge transporting layer of amorphous carbon, the charge transporting layer having a relative dielectric constant of 2.0 to 6.0 and containing 0.1 to 67 atomic % of hydrogen based on the combined amount of carbon and hydrogen contained in the transporting layer and 0.1 to 25 atomic % of a halogen based on all the constituent atoms of the transporting layer.

DETAILED DESCRIPTION OF THE INVENTION

Figure 1:
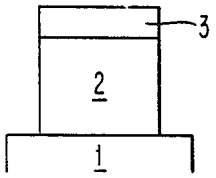
FIGS. 1 to 6 are diagrams showing photosensitive members embodying the invention.

The charge transporting layer of the photosensitive member embodying the invention is characterized in that the layer comprises a plasma-polymerized organic layer prepared by a plasma polymerization reaction under low organic gas pressure and containing atoms of a halogen as a chemically modifying substance, or a plasma-polymerized organic layer similarly prepared and containing atoms of a halogen, and oxygen atoms and/or nitrogen atoms. The plasma-polymerized organic layer is an amorphous carbon layer (hereinafter referred to as "a-C layer"). It is possible to determine the quantities of carbon atoms, hydrogen atoms, halogen atoms, oxygen atoms and nitrogen atoms in this layer by usual methods of elementary analysis, such as organic elementary analysis and Auger electron spectroscopy. The charge transporting layer does not exhibit distinct photoconductive properties when exposed to visible light or light in the vicinity of semiconductor laser beams in wavelength, but has suitable ability to transport charges with good stability and is excellent in characteristics for use in electrophotographic photosensitive members, e.g., in chargeability, durability and resistance to weather and to environmental pollution, and also in transmittancy. The layer therefore affords a high degree of freedom also in providing laminate structures for use as photosensitive members of the function separated type.

We have conducted research on the application of plasma-polymerized organic layers to photosensitive members and found that the polymerized layer, which is originally thought to be an insulating layer, readily exhibits ability to transport charges with a reduced specific resistivity when incorporating a halogen as a chemically modifying substance. Although much still remains to be clarified in detail for the theoretical interpretation of this finding, the result achieved will presumably be attributable to electrons in a relatively unstable state, such as $\pi$-electrons, unpaired electrons, remaining free radicals and the like, which are captured in a charge generating layer and which effectively contribute to charge transportability owing to polarization or a change in a stereo structure or the like due to the presence of halogen atoms.

The polymerized layer, when free from any halogen, is liable to exhibit impaired transportability, i.e. reduced sensitivity, with the lapse of time after formation, whereas we have found that the presence of halogen atoms serving as a chemically modifying substance enables the charge transporting layer to retain high transportability with good stability despite the lapse of time. We have also found that the presence of halogen atoms assures the photosensitive member of suitable light decay characteristics in the low potential region, with the light decay curve sharply sloping down in this region, producing a remarkable effect to inhibit the occurrence of residual potential. We have further found that the presence of halogen atoms greatly expedites the formation of the charge transporting layer which must have a considerable thickness, as required for efficient preparation of the layer.

Additionally, we have found that traces of oxygen atoms and/or nitrogen atoms incorporated into the charge transporting layer along with halogen atoms effectively prevent the impairment of dark decay characteristics with time.

According to the present invention, hydrocarbons are used as organic gases for forming the a-C layer. These hydrocarbons need not always be in a gaseous phase at room temperature at atmospheric pressure but can be in a liquid or solid phase insofar as they can be vaporized on melting, evaporation or sublimation, for example, by heating or in a vacuum. Examples of useful hydrocarbons are saturated hydrocarbons, unsaturated hydrocarbons, alicyclic hydrocarbons, aromatic hydrocarbons and the like. Such hydrocarbons are usable in combination.

A wide variety of hydrocarbons are usable. Examples of useful saturated hydrocarbons are normal paraffins such as methane, ethane, propane, butane, pentane, hexane, heptane, octane, nonane, decane, undecane, dodecane, tridecane, tetradecane, pentadecane, hexadecane, heptadecane, octadecane, nonadecane, eicosane, heneicosane, docosane, tricosane, tetracosane, pentacosane, hexacosane, heptacosane, octacosane, nonacosane, triacontane, dotriacontane, pentatriacontane, etc.; isoparaffins such as isobutane, isopentane, neopentane, isohexane, neohexane, 2,3-dimethylbutane, 2-methylhexane, 3-ethylpentane, 2,2-dimethylpentane, 2,4-dimethylpentane, 3,3-dimethylpentane, tributane, 2-methylheptane, 3-methylheptane, 2,2-dimethylhexane, 2,2,5-trimethylhexane, 2,2,3-trimethylpentane, 2,2,4-trimethylpentane, 2,3,3-trimethylpentane, 2,3,4-trimethylpentane, isononane, etc.; and the like.

Examples of useful unsaturated hydrocarbons are olefins such as ethylene, propylene, isobutylene, 1-butene, 2-butene, 1-pentene, 2-pentene, 2-methyl-1-butene, 3-methyl-1-butene, 2-methyl-2-butene, 1-hexene, tetramethylethylene, 1-heptene, 1-octene, 1-nonene, 1-decene and the like; diolefins such as allene, methylallene, butadiene, pentadiene, hexadiene, cyclopentadiene and the like; triolefins such as ocimene, alloocimene, myrcene, hexatriene and the like; acetylene, methylacetylene, 1-butyne, 2-butyne, 1-pentyne, 1-hexyne, 1-heptyne, 1-octyne, 1-nonyne, 1-decyne and the like.

Examples of useful alicyclic hydrocabons are cycloparaffins such as cyclopropane, cyclobutane, cyclopentane, cyclohexane, cycloheptane, cyclooctane, cyclononane, cyclodecane, cycloundecane, cyclododecane, cyclotridecane, cyclotetradecane, cyclopentadecane, cyclohexadecane and the like; cycloolefins such as cyclopropene, cyclobutene, cyclopentene, cyclohexene, cycloheptene, cyclooctene, cyclononene, cyclodecene and the like; terpenes such as limonene, terpinolene, phellandrene, sylvestrene, thujene, carene, pinene, bornylene, camphene, fenchene, cyclofenchene, tricyclene, bisabolene, zingiberene, curcumene, humulene, cadinene sesquibenihene, selinene, caryophyllene, santalene, cedrene, camphorene, phyllocladene, podocarprene, mirene and the like; steroids; etc.

Examples of useful aromatic hydrocarbons are benzene, toluene, xylene, hemimellitene, pseudocumene, mesitylene, prehnitene, isodurene, durene, pentamethylbenzene, hexamethylbenzene, ethylbenzene, propylbenzene, cumene, styrene, biphenyl, terphenyl, diphenylmethane, triphenylmethane, dibenzyl, stilbene, indene, naphthalene, tetralin, anthracene, phenanthrene and the like.

The a-C layer of the present invention contains 0.1 to 67 atomic %, preferably 30 to 60 atomic %, of hydrogen atoms based on the combined amount of carbon and hydrogen atoms present. If the amount of hydrogen atoms is less than 0.1 atomic %, reduced transportability will result, failing to give suitable sensitivity, whereas amounts of hydrogen atoms exceeding 67 atomic % entail reduced chargeability and impaired film-forming ability.

The hydrogen content of the a-C layer of the invention is variable in accordance with the film forming apparatus and film forming conditions. The hydrogen content can be decreased, for example, by elevating the substrate temperature, lowering the pressure, reducing the degree of dilution of the starting materials, i.e. the hydrocarbon gases, applying a greater power, decreasing the frequency of the alternating electric field to be set up or increasing the intensity of a d.c. electric field superposed on the alternating electric field.

It is suitable that the a-C layer serving as the charge transporting layer of the invention be 5 to 50 μm, preferably 7 to 20 μm, in thickness for use in the usual electrophotographic process. Thicknesses smaller than 5 μm result in a lower charge potential, failing to give a sufficient copy image density, whereas thicknesses larger than 50 μm are not desirable in view of productivity. The a-C layer is high in transmittancy, dark resistivity and charge transportability, traps no carriers even when not smaller than 5 μm in thickness as mentioned above and contributes to light decay.

According to the present invention, halogen compounds are used in addition to hydrocarbons in order to incorporate atoms of a halogen into the a-C layer. The term "halogen" as used herein refers to fluorine, chlorine, bromine and iodine. The halogen compounds to be used need not always be in a gaseous phase at room temperature at atmospheric pressure but can be in a liquid or solid phase insofar as they can be vaporized on melting, evaporation or sublimation, for example, by heating or in a vacuum. While halogens such as fluorine, chlorine, bromine and iodine are usable in this invention, examples of useful halogen compounds are inorganic compounds such as hydrogen fluoride, chlorine fluoride, bromine fluoride, iodine fluoride, hydrogen chloride, bromine chloride, iodie chloride, hydrogen bromide, iodine bromide and hydrogen iodide; and organic compounds such as alkyl halides, aryl halides, styrene halides, polymethylene halides and haloforms. Examples of such alkyl halides are methyl fluoride, methyl chloride, methyl bromide, methyl iodide, ethyl fluoride, ethyl chloride, ethyl bromide, ethyl iodide, propyl fluoride, propyl chloride, propyl bromide, propyl iodide, butyl fluoride, butyl chloride, butyl bromide, butyl iodide, amyl fluoride, amyl chloride, amyl bromide, amyl iodide, hexyl fluoride, hexyl chloride, hexyl bromide, hexyl iodide, heptyl fluoride, heptyl chloride, heptyl bromide, heptyl iodide, octyl fluoride, octyl chloride, octyl bromide, octyl iodide, nonyl fluoride, nonyl chloride, nonyl bromide, nonyl iodide, decyl fluoride, decyl chloride, decyl bromide, decyl iodide and the like. Examples of useful aryl halides are fluorobenzene, chlorobenzene, bromobenzene, iodobenzene, chlorotoluene, bromotoluene, chloronaphthalene, bromonaphthalene and the like. Examples of useful styrene halides are chlorostyrene, bromostyrene, iodostyrene, fluorostyrene and the like. Examples of useful polymethylene halides are methylene chloride, methylene bromide, methylene iodide, ethylene chloride, ethylene bromide, ethylene iodide, trimethylene chloride, trimethylene bromide, trimethylene iodide, dibutane chloride, dibutane bromide, dibutane iodide, dipentane chloride, dipentane bromide, dipentane iodide, dihexane chloride, dihexane bromide, dihexane iodide, diheptane chloride, diheptane bromide, diheptane iodide, dioctane chloride, dioctane bromide, dioctane iodide, dinonane chloride, dinonane bromide, didecane chloride, didecane iodide and the like. Examples of useful haloforms are fluoroform, chloroform, bromoform, iodoform and the like.

Halogen atoms are incorporated in the charge transporting layer of the invention as a chemically modifying substance in an amount of 0.1 to 25 atomic %, preferably 0.3 to 15 atomic %, most preferably 0.5 to 10 atomic %, based on all the constituent atoms of the layer. When the halogen atom content is lower than 0.1 atomic %, suitable charge transportability is not always available, with a likelihood of reduced sensitivity or occurrence of residual potential, while the layer fails to retain good sensitivity stability with time. If the halogen atom content is higher than 25 atomic %, the halogen which assures suitable charge transportability and inhibition of residual potential when present in a suitable amount conversely impairs the chargeability, further acting to lower the dark resistivity with time and to diminish the charge retentivity during storage for several months. Moreover, excessive halogen contents do not always assure satisfactory formation of the layer but permit separation of the layer or formation of an oily or powdery layer.

The quantity of halogen atoms to be contained in the layer and serving as a chemically modifying substance is controllable primarily by varying the amount of the halogen compound to be introduced into a reactor for plasma polymerization. The use of an increased quantity of halogen compound gives a higher halogen atom content to the a-C layer of the invention, whereas a decreased quantity of halogen compound results in a lower halogen atom content.

In case of using fluorine atoms as a halogen, it is desirable that the a-C layer of the present invention has a ratio of $\alpha_1$ to $\alpha_2$ in an amount of about 0.2 to 1.0, more preferably 0.3 to 0.9, wherein $\alpha_1$ represents absorption coefficient peak attributed to the carbon-fluorine bond at about 1120 $cm^{-1}$ and $\alpha_2$ represents absorption coefficient peak attributed to the carbon-hydrogen bond at about 1460 $cm^{-1}$ in the infrared absorption spectrum.

In addition to halogen atoms, oxygen atoms can be incorporated into the a-C layer of the invention, using an oxygen compound. The oxygen compound need not always be in a gas phase at room temperature at atmospheric pressure but can be a liquid or solid provided that the compound can be vaporized on melting, evaporation or sublimation, for example, when heated or subjected to a vacuum. While oxygen and ozone are usable for this purpose, examples of useful oxygen compounds are inorganic compounds such as water (water vapor), hydrogen peroxide, carbon monoxide, carbon dioxide, carbon suboxide, nitrogen monoxide, nitrogen dioxide, dinitrogen trioxide, dinitrogen pentoxide and nitrogen trioxide; organic compounds having a functional group or linkage such as hydroxyl group (—OH), aldehyde group (—COH), acyl group (RCO— or —CRO), ketone group (>CO), nitro group (—$NO_2$), nitroso group (—NO), sulfo group (—$SO_3H$), ether linkage (—O—), ester linkage (—COO—), peptide linkage (—CONH—), oxygen-containing heterocyclic ring or the like; and metal alkoxides. Examples of useful organic compounds having a hydroxyl group include alcohols such as methanol, ethanol, propanol, butanol, allyl alcohol, fluoroethanol, fluorobutanol, phenol, cyclohexanol, benzyl alcohol and furfuryl alcohol. Examples of useful organic compounds having an aldehyde group are formaldehyde, acetaldehyde, propioaldehyde, butyraldehyde, glyoxal, acrolein, benzaldehyde, furfural and the like. Examples of useful organic compounds having an acyl group are formic acid, acetic acid,propionic acid, butyric acid, valeric acid, palmitic acid, stearic acid, oleic acid, oxalic acid, malonic acid, succinic acid, benzoic acid, toluic acid, salicylic acid, cinnamic acid, naphthoic acid, phthalic acid, furoic acid and the like. Examples of suitable organic compounds having a ketone group are acetone, ethyl methyl ketone, methyl propyl ketone, butyl methyl ketone, pinacolone, diethyl ketone, methyl vinyl ketone, mesityl oxide, methylheptenone, cyclobutanone, cyclopentanone, cyclohexanone, acetophenone, propiophenone, butyrophenone, valerophenone, dibenzyl ketone, acetonaphthone, acetothienone, acetofuron and the like. Examples of suitable organic compounds having a nitro group are nitrobenzene, nitrotoluene, nitroxylene, nitronaphthalene and the like. Exemplary of suitable organic compounds having a nitroso group are nitrosobenzene, nitrosotoluene, nitrosonaphthalene, nitrosocresol and the like. Examples of useful organic compounds having a sulfo group are methanesulfonic acid, benzenesulfonic acid, naphthalenesulfonic acid and the like. Examples of useful organic compounds having an ether linkage are methyl ether, ethyl ether, propyl ether, butyl ether, amyl ether, ethyl methyl ether, methyl propyl ether, methyl butyl ether, methyl amyl ether, ethyl propyl ether, ethyl butyl ether, ethyl amyl ether, vinyl ether, allyl ether, methyl vinyl ether, methyl allyl ether, ethyl vinyl ether, ethyl allyl ether, anisole, phenetole, phenyl ether, benzyl ether, phenyl benzyl ether, naphthyl ether, ethylene oxide, propylene oxide, trimethylene oxide, tetrahydrofuran, tetrahydropyran, dioxane and the like. Examples of useful organic compounds having an ester linkage are methyl formate, ethyl formate, propyl formate, butyl formate, amyl formate, methyl acetate, ethyl acetate, propyl acetate, butyl acetate, amyl acetate, methyl propionate, ethyl propionate, propyl propionate, butyl propionate, amyl propionate, methyl butyrate, ethyl butyrate, propyl butyrate, butyl butyrate, amyl butyrate, methyl valerate, ethyl valerate, propyl valerate, butyl valerate, amyl valerate, methyl benzoate, ethyl benzoate, methyl cinnamate, ethyl cinnamate, propyl cinnamate, methyl salicylate, ethyl salicylate, propyl salicylate, butyl salicylate, amyl salicylate, methyl anthranilate, ethyl anthranilate, butyl anthranilate, amyl anthranilate, methyl phthalate, ethyl phthalate, butyl phthalate and the like. Examples of useful organic compounds having a peptide linkage are α-D-glucoheptitol, β-D-glucoheptitol and the like. Examples of useful heterocyclic compounds are furan, oxazole, furazane, pyran, oxazine, morpholine, benzofuran, benzoxazole, chromene, chroman, dibenzofuran, xanthene, phenoxazine, oxirane, dioxirane, oxathiorane, oxadiazine, benzoisooxazole and the like. Examples of useful metal alkoxides are lithium isopropylate, lithium tertiary butylate, sodium isopropylate, potassium isopropylate, magnesium ethylate, calcium ethylate, strontium methylate, barium ethylate, barium isopropylate, methyl borate, ethyl borate, butyl borate, aluminum ethylate, aluminum isopropylate, aluminum butylate, gallium isopropylate, methyl silicate, ethyl silicate, isopropyl silicate, germanium methylate, germanium propylate, germanium ethylate, methyl phosphate, antimony ethylate, antimony butylate, indium isopropylate, zinc ethylate, yttrium isopropylate, lanthanum isopropylate, titanium isopropylate, titanium butylate, zirconium ethylate, zirconium isopropylate, hafnium isopropylate, vanadium methylate, vanadium ethylate, vanadium butylate, vanadyl ethylate, vanadyl tertiary butylate, niobium ethylate, tantalum ethylate, iron isopropylate, tin methylate, tin ethylate, tin isopropylate, tin butylate and the like.

According to the present invention, doping of oxygen in addition to halogen can prevent the impairment of dark decay characteristics after lapse of time.

Oxygen atoms, serving as another chemically modifying substance, are preferably incorporated in the a-C layer in an amount of 0.1 to 7.0 atomic %, more preferably 0.1 to 4.7 atomic %, based on all the constituent atoms of the layer. If the oxygen atom content exceeds 7.0 atomic %, the sensitivity characteristics due to satisfactory charge transportability as afforded by the presence of the halogen are not always available. On the other hand, when the a-C layer contains less than 0.1 atomic % of oxygen atoms, dark resistivity may become high, but it does not impair the electrophotographic characteristics of the member.

The quantity of oxygen atoms to be contained in the a-C layer and serving as a chemically modifying substance is controllable primarily by varying the amount of the oxygen compound to be introduced into the reactor for plasma polymerization. The use of an increased amount of oxygen compound gives a higher oxygen atom content to the a-C layer of the invention, whereas a decreased quantity of oxygen compound results in a lower oxygen atom content.

In case of containing oxygen in the a-C layer of the present invention, it is desirable that the a-C layer of the present invention has a ratio of $\alpha_3$ to $\alpha_4$ in an amount of about less than 1.0, more preferably less than 0.8, wherein $\alpha_3$ represents absorption coefficient peak attributed to the carbon-oxygen double bond (>C=O) at about 1700 $cm^{-1}$ and $\alpha_4$ represents absorption coefficient peak attributed to the carbon-carbon double bond (>C=C<) at about 1600 $cm^{-1}$ in the infrared absorption spectrum.

The a-C layer of the present invention may contain nitrogen atoms in addition to halogen atoms. Furthermore, atoms of the three elements, i.e. halogen, oxygen and nitrogen, may be incorporated therein. Nitrogen compounds are used for incorporating nitrogen atoms. Such nitrogen compounds need not always be in a gaseous phase at room temperature at atmospheric pressure but can be in a liquid or solid phase provided that they can be vaporized on melting, evaporation or sublimation, for example, when heated or subjected to a vacuum. While nitrogen per se is usable, examples of useful nitrogen compounds include inorganic compounds such as ammonia, nitrogen monoxide, nitrogen dioxide, dinitrogen trioxide, dinitrogen pentoxide and nitrogen trioxide; and organic compounds having a functional group or linkage such as amino group (—NH ), cyano group (—CN), nitro group (—$NO_2$), nitroso group (—NO), isocyanic acid ester linkage (—NCO), isothiocyanic acid ester linkage (—NCS), azothioether linkage (—N=NS—), peptide linkage (—CONH—), nitrogen-containing heterocyclic ring or the like. Examples of useful organic compounds having an amino group are methylamine, ethylamine, propylamine, butylamine, amylamine, hexylamine, heptylamine, octylamine, nonylamine, decylamine, undecylamine, dodecylamine, tridecylamine, tetradecylamine, pentadecylamine, cetylamine, dimethylamine, diethylamine, dipropylamine, dibutylamine, diamylamine, trimethylamine, triethylamine, tripropylamine, tributylamine, triamylamine, allylamine, diallylamine, triallylamine, cyclopropylamine, cyclobutylamine, cyclopentylamine, cyclohexylamine, aniline, methylaniline, dimethylaniline, ethylaniline, diethylaniline, toluidine, benzylamine, dibenzylamine, tribenzylamine, diphenylamine, triphenylamine, naphthylamine, ethylenediamine, trimethylenediamine, tetramethylenediamine, pentamethylenediamine, hexamethylenediamine, diaminoheptane, diaminooctane, diaminononane, diaminodecane, phenylenediamine and the like. Examples of useful organic compounds having a cyano group are acetonitrile, propionitrile, butyronitrile, valeronitrile, capronitrile, enanthonitrile, caprylonitrile, pelargonnitrile, caprinitrile, lauronitrile, palmitonitrile, stearonitrile, crotononitrile, malonitrile, succinonitrile, glutaronitrile, adiponitrile, benzonitrile, tolunitrile, cyanobenzylic cinnamonitrile, naphthonitrile, cyanopyridine and the like. Examples of useful organic compounds having a nitro group are nitrobenzene, nitrotoluene, nitroxylene, nitronaphthalene and the like. Exampls of useful organic compounds having a nitroso group are nitrosobenzene, nitrosotoluene, nitrosonaphthalene, nitrocresol and the like. Examples of useful organic compounds having an isocyanic acid ester linkage are methyl isocyanate, ethyl isocyanate, propyl isocyanate, butyl isocyanate, phenyl isocyanate, naphthyl isocyanate and the like. Examples of useful isothiocyanic acid ester linkage are methyl isothiocyanate, ethyl isothiocyanate, propyl isothiocyanate, butyl isothiocyanate, amyl isothiocyanate, allyl isothiocyanate, phenyl isothiocyanate, benzyl isothiocyanate and the like. Examples of useful organic compounds having an azothioether linkage are benzene diazothiophenyl ether, chlorobenzene diazothiophenyl ether, bromobenzene diazothiophenyl ether, nitrobenzene diazothiophenyl ether phenyldiazomercaptonaphthalene, benzenediazothioglycolic acid, bromobenzenediazothioglycolic acid, nitrobenzenediazothioglycolic acid and the like. Examples of useful organic compounds having a peptide linkage are α-D-glucoheptitol, β-D-glucoheptitol and the like. Examples of useful heterocyclic compounds are pyrrole, pyrroline, pyrrolidine, oxazole, thiazole, imidazole, imidazoline, imidazolidine, pyrazole, pyrazoline, pyrazolidine, triazole, tetrazole, pyridine, piperidine, oxazine, morpholine, thiazine, pyridazine, pyrimidine, pyrazine, piperazine, triazine, indole, indoline, benzoxazole, indazole, benzimidazole, quinoline, cinnoline, phthalazine, phthalocyanine, quinazoline, quinoxaline, carbazole, acridine, phenanthridine, phenazine, phenoxazine, indolizine, quinolizine, quinuclidine, naphthyridine, purine, pteridine, aziridine, azepine, oxadiazine, dithiazine, benzoquinoline, imidazothiazole and the like.

According to the present invention, doping of nitrogen in addition to halogen can prevent the impairment of dark decay characteristics after lapse of time.

Nitrogen atoms, serving as another chemically modifying substance, are preferably incorporated in the a-C layer in an amount of 0.1 to 5.0 atomic %, more preferably 0.1 to 3.9 atomic %, based on all the constituent atoms of the layer. If the nitrogen atom content exceeds 5.0 atomic %, the sensitivity characteristics due to satisfactory charge transportability as afforded by the presence of the halogen are not always available. On the other hand, when the a-C layer contains less than 0.1 atomic % of nitrogen atoms, dark resistivity may become high, but it does not impair the electrophotographic characteristics of the member.

The quantity of nitrogen atoms to be contained in the a-C layer and serving as a chemically modifying substance is controllable primarily by varying the amount of nitrogen compound to be introduced into the reactor for plasma polymerization. The use of an increased amount of nitrogen compound gives a higher nitrogen atom content to the a-C layer of the invention, whereas a decreased quantity of nitrogen compound results in a lower nitrogen atom content.

According to the invention, atoms of elements in Group IIIA or Group VA of the Periodic Table may further be incorporated into the a-C layer containing oxygen atoms and/or nitrogen atoms in addition to halogen atoms. This gives the layer improved ability to transport both positive and negative carriers, higher sensitivity and greater freedom from residual potential. The content of an element from Group IIIA or VA of the Periodic Table is up to 50,000 atm. ppm, preferably 1,000 to 50,000 atm. ppm, more preferably 5,000 to 20,000 atm. ppm, based on all the constituent atoms of the a-C layer.

With the present invention, silicon atoms, germanium atoms, tin atoms or chalcogen atoms may further be incorporated into the a-C layer containing oxygen atoms and/or nitrogen atoms in addition to halogen atoms. The presence of such hetero atoms imparts to the a-C layer improved ability to transport both positive and negative carriers, further achieving improvements, for example, in the surface smoothness of the photosensitive member, transmittancy and the adhesion between the layer and the substrate. Alternatively, such hetero atoms may be incorporated in order to prepare the photosensitive member with good stability.

For example, when the a-C layer is positioned immediately adjacent to the substrate, it is useful to incorporate oxygen atoms, nitrogen atoms, chalcogen atoms, atoms of an element from Group IV of the Periodic Table, or the like into the a-C layer for giving improved adhesion to the substrate against separation. Further when containing a large amount of silicon atoms or the like, the layer becomes serviceable also as a barrier layer in some cases. The content of such hetero atoms is not limited specifically insofar as the contemplated purpose can be attained. The above-mentioned elements may be used singly or in combination. Depending on the purpose, such atoms may be present locally at a specified position within the charge transporting layer, or may have a concentration distribution.

The a-C layer of the invention is preferably 1.5 to 3.0 eV in optical energy gap Egopt and 2.0 to 6.0 in relative dielectric constant $\epsilon$.

It is thought that a film of small Egopt (less than 1.5 eV) has a large number of levels in the vicinity of band end, i.e. at the lower end of conduction band or upper end of filled band. Accordingly, it is likely that such an a-C layer is not always satisfactorily serviceable as the charge transporting layer of a photosensitive member because of low carrier mobility and shortened life of carriers. When having a great Egopt (greater than 3.0 eV), the a-C layer is liable to form a barrier with the charge generating material and the charge transporting material which are usually used in electrophotography, with the resulting likelihood that carriers will not be smoothly injected into the a-C layer of great Egopt from the charge generating or transporting material. Consequently, the photosensitive member having the a-C layer will not exhibit satisfactory characteristics.

On the other hand, the relative dielectric constant, if greater than 6.0, leads to impaired chargeability and lower sensitivity. An a-C layer of increased thickness appears useful for remedying these properties but is not desirable from the viewpoint of productivity. Preferably, the $\epsilon$ value should not be smaller than 2.0 since lower values permit the layer to exhibit polyethylenical properties or characteristics and lower chargeability.

The charge transporting a-C layer of the present invention does not by itself generate optically excited carriers when exposed to visible light having emission wavelengths of about 450 to 650 nm, to the light from LEDs having emission wavelengths of about 650 to 700 nm or to the light from semiconducter lasers having emission wavelengths of about 750 to 800 nm, i.e., to the light from light sources commonly used in usual electrophotographic processes. Accordingly, even if the a-C layer of the invention as singly provided on an electrically conductive substrate is used for the usual electrophotographic process, the resulting structure fails to form any latent image and is therefore unusable as a photosensitive member. Should the layer be developed by the normal method after an exposure or without exposure, a solid black image only would invariably be obtained.

The charge transporting a-C layer of the present invention functions as a satisfactory photosensitive member only when formed on or beneath a charge generating layer which is capable of efficiently producing optically excited carriers when exposed to the light from a light source such as one mentioned above and which is adapted to efficiently inject the excited carriers into the a-C layer.

Thus, the a-C layer of the invention does not serve as a charge generating layer but functions as a charge transporting layer only.

While research has yet to be made to determine the arrangement of energy bands in the a-C layer before clarifying why the a-C layer of the invention functions as a charge transporting layer but not as a charge generating layer, the reason will presumably be that although the a-C layer, when to be serviceable as a charge generating layer, must permit excitation of carriers through direct transition from the valence band to the conduction band, the energy therefor is not available from light sources of the foregoing wavelength ranges. Nevertheless, in the case where the a-C layer is formed in combination with a charge generating layer which is adapted for efficient excitation of carriers upon exposure to the light of above-mentioned wavelength range, the excited carriers are injected into the a-C layer and thereby smoothly transported without being trapped (because the layer has only a small number of trapping centers or recombination centers), consequently assuring suitable light decay.

Whereas the energy bands in the a-C layer of the invention include those of smaller energy than the light of 550 nm (central wavelength of visible light; 2.25 eV), the layer fails to generate optically excited carriers presumably because the Eg (quasi-forbidden band gap) as determined by the energy band measuring method, i.e., by optical absorption, is not always in coincidence with the Eg (true forbidden band gap) actually participating in the generation of carriers in the layer owing to the presence of various impurity levels.

The charge generating layer to be incorporated into the photosensitive member of the present invention is not limited specifically in its material. Examples of materials that are usable are inorganic substances such as amorphous selenium, selenium-arsenic, selenium-tellurium, cadmium sulfide, zinc oxide, and amorphous silicon which contains different elements (e.g. hydrogen, boron, carbon, nitrogen, oxygen, fluorine, phosphorus, sulfur, chlorine, bromine, germanium, etc.) for giving altered characteristics, and organic substances such as polyvinylcarbazole, cyanine compounds, metal phthalocyanine compounds, azo compounds, perillene compounds, triarylmethane compounds, triphenylmethane compounds, triphenylamine compounds, hydrazone compounds, styryl compounds, pyrazoline compounds, oxazole compounds, oxazine compounds, oxadiazole compounds, thiazine compounds, xanthene compounds, pyrylium compounds, quinacridone compounds, indigo compounds, polycyclic quinone compounds, disbenzimidazole compounds, indanthrone compounds and squalylium compounds. Other substances are also usable insofar as they are capable of efficiently producing optically excited carriers when exposed to light and efficiently injecting the carriers into the charge transporting layer.

The process for preparing the charge generating layer is not limited specifically. For example, this layer may be formed by the same process as the charge transporting layer (a-C layer) of the invention, electrodeposition in a liquid phase, spraying, dipping or like coating process, or the like. The same process as employed for preparing the charge transporting layer of the invention is desirable because of a reduced equipment cost and savings in labor.

The a-C layer of the present invention may be used also as an overcoat layer having charge transporting properties. The present a-C layer, even when used merely as an overcoat layer, affords high durability without resulting in a higher residual potential.

The photosensitive member of the present invention comprises a charge generating layer and a charge transporting layer of the type described above, which are formed in a superposed structure suitably determined as required.

Figure 2:
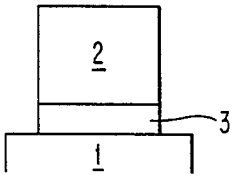
Figure 3:
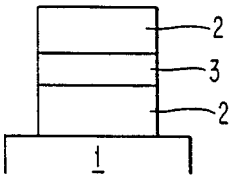

FIG. 1 shows a photosensitive member of one type comprising an electrically conductive substrate 1, a charge transporting layer 2 formed on the substrate and a charge generating layer 3 formed on the layer 2. FIG. 2 shows another type comprising an electrically conductive substrate 1, a charge generating layer 3 on the substrate and a charge transporting layer 2 on the layer 3. FIG. 3 shows another type comprising an electrically conductive substrate 1, and a charge transporting layer 2, a charge generating layer 3 and another charge transporting layer 2 formed over the substrate and arranged one over another.

These photosensitive members are used, for example, by positively charging the surface with a corona charger or the like and exposing the charged surface to an optical image. In the case of FIG. 1. the holes then generated in the charge generating layer 3 travel through the charge transport layer 2 toward the substrate 1. In FIG. 2, the electrons generated in the charge generating layer 3 travel through the charge transporting layer 2 toward the surface of the photosensitive member. In FIG. 3, the holes generated in the charge generating layer 3 travel through the lower charge transporting layer 2 toward the substrate 1, and at the same time, the electrons generated in the charge generating layer 3 travel through the upper transporting layer 2 toward the surface of the member. Consequently, an electrostatic latent image is formed, with satisfactory light decay assured. Conversely, when the surface of the photosensitive member is negatively charged and then exposed, the electron and the hole may be replaced by each other in respect of the above behavior for the interpretation of the travel of carriers. With the structures of FIGS. 2 and 3, the image projecting light passes through the charge transporting layer, which nevertheless has high transmittancy, permitting satisfactory formation of latent images.

Figure 4:
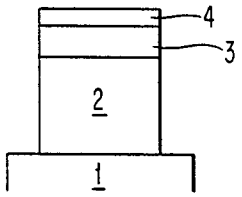

FIG. 4 shows another type comprising an electrically conductive substrate 1, and a charge transporting layer 2, a charge generating layer 3 and a surface protective layer 4 provided over the substrate and arranged one over another. Thus, the illustrated structure corresponds to the structure of FIG. 1 provided with a surface protective layer. Since the outermost surface of the structure of FIG. 1 is provided by a charge generating layer which is not limited specifically in the present invention, it is generally desirable that the surface be covered with a protective layer for assuring durability for use. With the structures of FIGS. 2 and 3, the charge transporting layer embodying the invention and having high durability provides the outermost surface, so that the surface protective layer need not be provided. However, such a photosensitive member can be formed with a surface protective layer as another type so as to be compatible with various other elements within the copying machine, for example, to be free from surface soiling deposition of developer.

Figure 5:
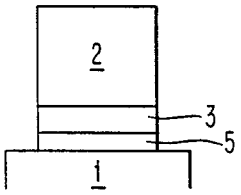

FIG. 5 shows another type comprising an electrically conductive substrate 1, and an intermediate layer 5, a charge generating layer 3 and a charge transporting layer 2 which are formed over the substrate and arranged one over another. Thus, this structure corresponds to the structure of FIG. 2 provided with an intermediate layer. Since a charge generating layer which is not limited specifically in the invention is joined to the substrate in the structure of FIG. 2, it is generally desirable to interpose an intermediate layer therebetween to assure good adhesion and an injection inhibitory effect. With the structures of FIGS. 1 and 3, the charge transporting layer of the invention which is excellent in adhesion and injection inhibitory effect is joined to the substrate, so that no intermediate layer may be provided. However, the photosensitive member of either of these types can be formed with an intermediate layer in order to render the transporting layer to be formed compatible with the preceding fabrication step, such as pretreatment of the conductive substrate.

Another type of photosensitive member is then available.

Figure 6:
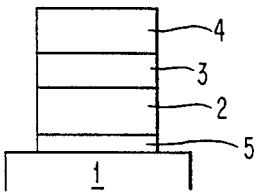

FIG. 6 shows still another type comprising an electrically conductive substrate 1, and an intermediate layer 5, a charge transporting layer 2, a charge generating layer 3 and a surface protective layer 4 which are formed over the substrate and superposed one over another. Thus, this structure corresponds to the structure of FIG. 1 provided with an intermediate layer and a surface protective layer. The intermediate and protective layers are formed for the same reasons as already stated. Thus, the provision of these two layers in the structure of FIGS. 2 or 3 affords another type.

According to the present invention, the intermediate layer and the surface protective layer are not limited specifically in material or fabrication process. Any material or process is suitably selectable provided that the contemplated object can be achieved. The a-C layer of the invention may be used. However, if the material to be used is an insulating material such as one already mentioned, the thickness of the layer needs to be up to 5 μm to preclude occurrence of residual potential.

The charge transporting layer of the photosensitive member embodying the present invention is produced by so-called plasma polymerization wherein molecules in a vapor phase are subjected to discharge decomposition in a vacuum phase, and the active neutral seeds or charge seeds contained in the resulting atmosphere of plasma are led onto a substrate by diffusion or an electric or magnetic force and accumulated into a solid phase on the substrate through a rebinding reaction.

Figure 7:
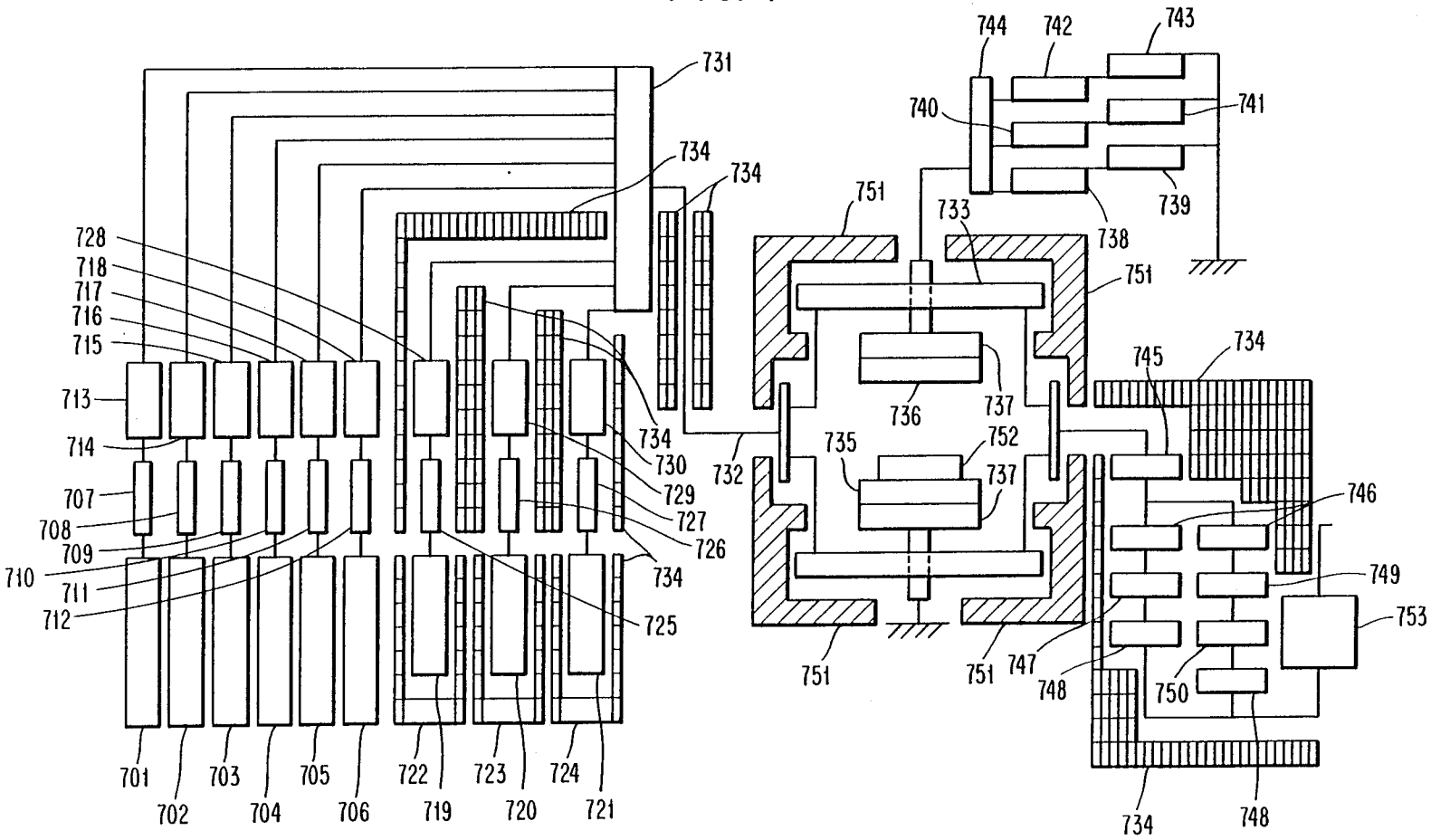
FIGS. 7 and 8 are diagrams showing apparatus for preparing photosensitive members according to the invention.

FIG. 7 shows an apparatus for preparing the photosensitive member of the invention. First to sixth tanks 701 to 706 have enclosed therein starting material compounds which are in gas phase at room temperature and a carrier gas and are connected respectively to first to sixth regulator valves 707 to 712 and first to sixth flow controllers 713 to 718. First to third containers 719 to 721 contain starting material compounds which are liquid or solid at room temperature, can be preheated by first to third heaters 722 to 724 for vaporizing the compounds, and are connected to seventh to ninth regulator valves 725 to 727 and seventh to ninth flow controllers 728 to 730, respectively. The gases to be used as selected from among these gases are mixed together by a mixer 731 and fed to a reactor 733 via a main pipe 732. The interconnecting piping can be heated by a pipe heater 734 which is suitably disposed so that the material compound, in a liquid or solid phase at room temperature and vaporized by preheating, will not condense during transport. A grounded electrode 735 and a power application electrode 736 are arranged as opposed to each other within the reactor 733. Each of these electrodes can be heated by an electrode heater 737. The power application electrode 736 is connected to a high-frequency power source 739 via a high-frequency power matching device 738, to a low-frequency power source 741 via a low-frequency power matching device 740 and to a d.c. power source 743 via a low-pass filter 742. Power of one of the different frequencies is applicable to the electrode 736 by way of a connection selecting switch 744. The internal pressure of the reactor 733 is adjustable by a pressure control valve 745. The reactor 733 is evacuated by a diffusion pump 747 and an oil rotary pump 748 via an exhaust system selecting valve 746, or by a cooling-removing device 749, a mechanical booster pump 750 and an oil rotary pump 748 via another exhaust system selecting valve 746. The exhaust gas is further made harmless by a suitable removal device 753 and then released to the atmosphere. The evacuation piping system can also be heated by a suitably disposed pipe heater 734 so that the material compound which is liquid or solid at room temperature and vaporized by preheating will not condense during transport. For the same reason, the reactor 733 can also be heated by a reactor heater 751. An electrically conductive substrate 752 is placed on the electrode 735 in the reactor. Although FIG. 7 shows that the substrate 752 is fixed to the grounded electrode 735, the substrate may be attached to the power application electrode 736, or to both the electrodes.

Figure 8:
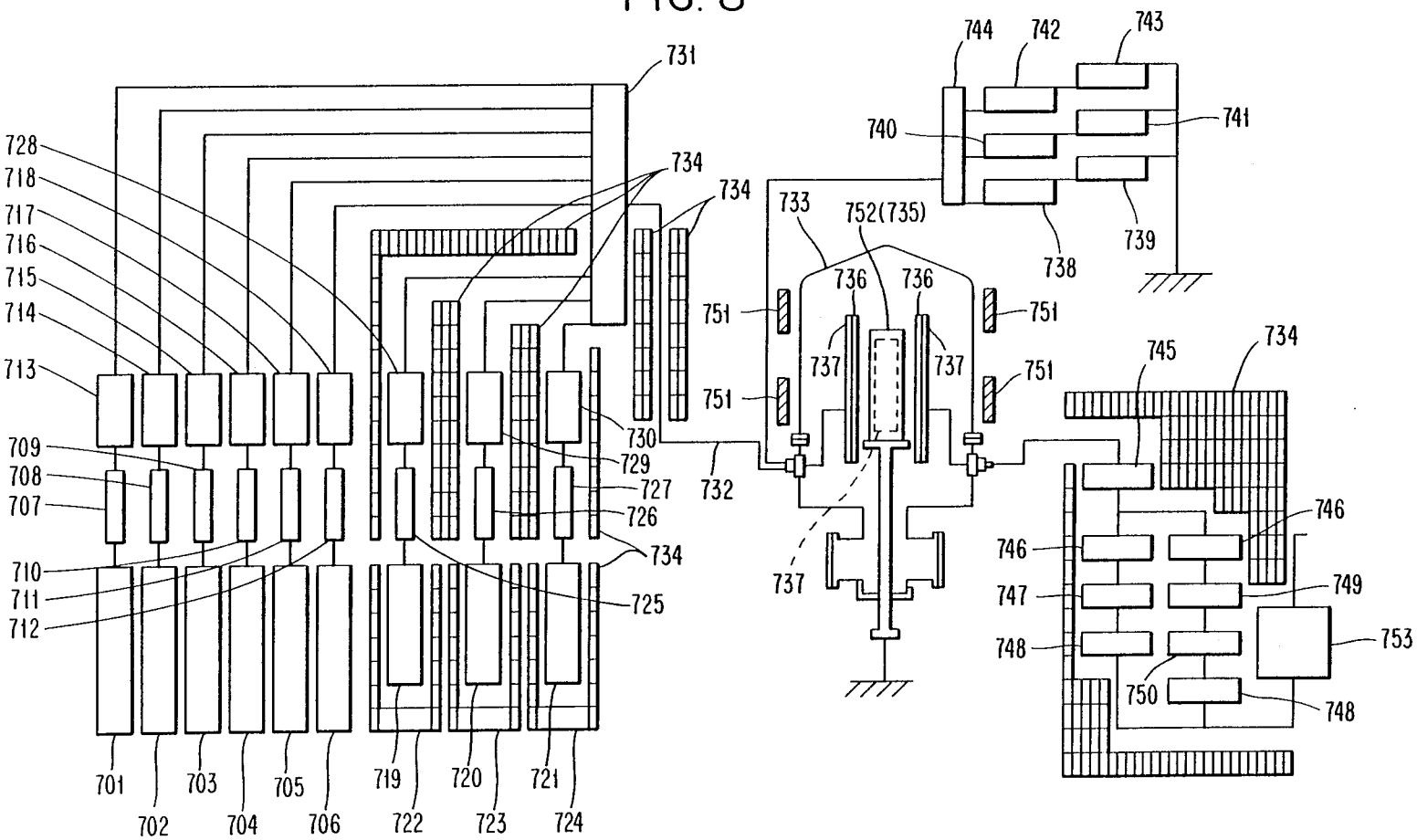

FIG. 8 shows another type of apparatus for preparing the photosensitive member of the invention. This apparatus has the same construction as the apparatus of FIG. 7 with the exception of the interior arrangement of the reactor 733. With reference to FIG. 8, the reactor 733 is internally provided with a hollow cylindrical electrically conductive substrate 752 serving also as the grounded electrode 735 of FIG. 7 and with an electrode heater 737 inside thereof. A power application electrode 736, similarly in the form of a hollow cylinder, is provided around the substrate 752 and surrounded by an electrode heater 737. The conductive substrate 752 is rotatable about its own axis by a drive motor from outside.

The reactor for preparing the photosensitive member is first evacuated by the diffusion pump to a vacuum of about $10^{-4}$ to about $10^{-6}$ torr, whereby the adsorbed gas inside the reactor is removed. The reactor is also checked for the degree of vacuum. At the same time, the electrodes and the substrate fixedly placed on the electrode are heated to a predetermined temperature. To obtain a photosensitive member of the desired one of the foregoing structures, an undercoat layer or a charge generating layer may be formed on the substrate before the charge transporting layer is formed when so required. The undercoat or charge generating layer may be formed by the present apparatus or by some other apparatus. Subsequently, material gases, i.e. suitably selected hydrocarbon, halogen compounds, oxygen compounds and nitrogen compounds, are fed into the reactor from the first to sixth tanks and the first to third containers (i.e. from those concerned), each at a specified flow rate, using the flow controllers concerned, and the interior of the reactor is maintained in a predetermined vacuum by the pressure control valve. After the combined flow of gases has become stabilized, the high-frequency power source, for example, is selected by the connection selecting switch to apply a high-frequency power to the power application electrode. The low-frequency power supply, 10 KHz to 1 MHz in frequency, may alternatively be selected. This initiates discharge across the two electrodes, forming a solid layer on the substrate with time. The thickness of the layer is controllable by varying the reaction time, such that the discharge is discontinued upon the thickness reaching the desired value. Consequently, an a-C layer of the invention is obtained which serves as a charge transporting layer.

The a-C layer comprising hydrogen and carbon is characterized in that it is prepared by containing 0.1 to 25 atomic % of halogen atoms as a chemical modifier based on all the constituent atoms therein, or in addition to halogen, 0.1 to 7 atomic % of oxygen atoms and/or 0.1 to 5 atomic % of nitrogen atoms based on all the constituent atoms therein.

Next, the regulator valves concerned are closed, and the reactor is thoroughly exhausted. When a photosensitive member of the desired structure has been formed according to the invention, the vacuum within the reactor is vitiated, and the member is removed from the reactor. If a charge generating layer or overcoat layer needs to be further formed to obtain the desired photosensitive structure, the layer is formed using the present apparatus as it is, or using another apparatus to which the product is transferred from the present apparatus after similarly breaking the vacuum, whereby the desired photosensitive member is obtained according to the invention.

The present invention will be described with reference to the following examples.

EXAMPLE 1

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. 7 was used. First, the interior of the reactor 733 was evacuated to a high vacuum of about $10^{-6}$ torr, and the first, second and third regulator valves 707, 708 and 709 were thereafter opened to introduce hydrogen gas from the first tank 701 into the first flow controller 713, ethylene gas from the second tank 702 into the second flow controller 714 and tetrafluoromethane gas from the third tank 703 into the third flow controller 715, each at an output pressure of 1.0 kg/cm$^2$. The dials on the flow controllers were adjusted to supply the hydrogen gas at a flow rate of 40 sccm, the ethylene gas at 30 sccm and the tetrafluoromethane gas at 120 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, which was an aluminum substrate measuring 50 mm in length, 50 mm in width and 3 mm in thickness, was preheated to 250° C. With the gas flow rates and the pressure in stabilized state, 200-watt power with a frequency of 13.56 MHz was applied to the power application electrode 736 from the high-frequency power source 739 preconnected thereto by the selecting switch 744 to conduct plasma polymerization for 5 hours, forming an a-C layer, 20 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 47 atomic % of hydrogen atoms based on the combined amount of carbon atoms and hydrogen atoms. Further, when subjected to auger electron spectroscopy, the a-C layer thus obtained was found to contain 3.1 atomic % of halogen atoms, i.e. fluorine atoms based on all the constituent atoms therein.

The ratio of $\alpha_1$ to $\alpha_2$ was measured by the infrared absorption spectrum within the range of 4000 cm$^{-1}$ to 450 cm$^{-1}$ using Infrared Fourier Transform Spectrometer 1710 (made by Perkin-Elmer Co , Ltd.). The obtained ratio of $\alpha_1$ to $\alpha_2$ was about 0.71.

Charge Generating Layer Forming Step (CGL):

Next, the first and sixth regulator valves 707 and 712 were opened to introduce hydrogen gas from the first tank 701 into the first flow controller 713 and silane gas from the sixth tank 706 into the sixth flow controller 718, each at an output pressure of 1.0 kg/cm$^2$. The dials on the flow controllers were adjusted to supply the hydrogen gas at a flow rate of 300 sccm and the silane gas at 100 sccm to the reactor 733. After the flows of the gases stabilized, the internal pressure of the reactor 733 was adjusted to 0.8 torr by the pressure control valve 745. On the other hand, the substrate 752 formed with the a-C layer was preheated to 250° C. With the gas flow rates and the pressure in stabilized state, 200-watt power with a frequency of 13.56 MHz was applied to the power application electrode 736 from the high-frequency power source 739 to effect glow discharge for 20 minutes, whereby a charge generating a-Si:H layer was formed with a thickness of 0.4 microns.

Characteristics:

When the photosensitive member obtained was used for the usual Carlson process, the member showed a maximum charge potential (hereinafter referred to as Vmax) of −700 V. Specifically, the chargeability per 1 micron (hereinafter referred to as C.A.) was 34.3 V by calculating from the entire thickness of the member, i.e. 20.4 microns, indicating that the member had satisfactory charging properties.

The period of time required for dark decay from Vmax to the potential corresponding to 90% of Vmax (hereinafter referred to as Td) was about 15 seconds, showing that the member has satisfactory charge retentivity.

The amount of light required for the light decay from Vmax to the potential corresponding to 20% of Vmax (hereinafter referred to as E) was about 2.5 lux-sec, showing that the member was satisfactory in photosensitive characteristics. Further, the photosensitive member was 1.9 in optical energy gap (Egopt) and 4.0 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLES 2 TO 6

The photosensitive members was prepared by exactly the same process as in Example 1 except that the flow rate of tetrafluoromethane were set to 90 (Example 2), 60 (Example 3), 30 (Example 4), 20 (Example 5), 12 (Example 6) sccm.

When subjected to CHN quantitative analysis, the respective a-C layers thus obtained were found to contain 49, 50, 53, 53 and 54 atomic % of hydrogen atoms based on the combined amount of carbon atoms and hydrogen atoms. Further, when subjected to auger electron spectroscopy, the respective a-C layers thus obtained were found to contain 2.5, 2.0, 1.2, 0.8 and 0.5 atomic % of halogen atoms, i.e. fluorine atoms based on all the constituent atoms therein. Moreover, the thickness of the respective a-C layers were 16, 13, 9.5, 8.5 and 7.5 microns.

Characteristics:

When the photosensitive members obtained were used for the usual Carlson process, the respective members showed a Vmax of −700, −700, −650, −600 and −600 V. Specifically, the C.A. of the respective members were 42.7, 52.2, 65.7, 67.4 and 75.9 V by calculating from the entire thickness of the respective members, i.e. 16.4, 13.4, 9.9, 8.9 and 7.9 microns, indicating that these members had satisfactory charging properties.

Further, the Td of the respective members were about 15, 15, 20, 25 and 30 seconds, showing that these members had satisfactory charge retentivity.

The E of the respective members were about 2.6, 2.8, 3.1, 3.5 and 4.2 lux-sec, showing that these members were satisfactory in photosensitive characteristics. Further, the photosensitive members were 2.0, 2.1, 2.1, 2.4 and 2.4 in optical energy gap (Egopt) and 3.5, 3.3, 3.1, 3.0 and 2.8 in relative dielectric constant.

These results indicate that these photosensitive members prepared in the present examples according to the invention exhibit outstanding performance. When these members were used in the Carlson process for forming images thereon, followed by image transfer, sharp copy images were obtained.

EXAMPLE 7

The photosensitive member was prepared by exactly the same process as in Example 1 except that the flow rate of tetrafluoromethane was set to 7 sccm.

When subjected to CHN quantitative analysis, the a-C layer thus obtained was found to contain 54 atomic % of hydrogen atoms based on the combined amount of carbon atoms and hydrogen atoms. Further, when subjected to auger electron spectroscopy, the a-C layer thus obtained was found to contain 0.3 atomic % of halogen atoms, i.e. fluorine atoms based on all the constituent atoms therein. Moreover, the thickness of the a-C layer was 7 microns.

The ratio of $\alpha_1$ to $\alpha_2$ was measured by the infrared absorption spectrum within the range of 4000 $cm^{-1}$ to 450 $cm^{-1}$ using Infrared Fourier Transform Spectr.ometer 1710 (made by Perkin-Elmer Co., Ltd.). The obtained ratio of $\alpha_1$ to $\alpha_2$ was about 0.31.

Characteristics:

When the photosensitive member obtained was used for the usual Carlson process, the member showed a Vmax of −600 V. Specifically, the C.A. of the member was 81.1 V by calculating from the entire thickness of the member, i.e. 7.4 microns, indicating that the member had satisfactory charging properties.

Further, the Td of the member was about 30 seconds, showing that the member had satisfactory charge retentivity.

The E of the member was about 7.2 lux-sec, showing that the member was satisfactory in photosensitive characteristics Further, the photosensitive member was 2.5 in optical energy gap (Egopt) and 3.0 in relative dielectric constant.

Further, when the photosensitive members shown in Examples 1 to 6 were remeasured in the E three after months formation, the members showed the values almost equal to the value of E (The remeasured value of E is hereinafter referred to as E'). On the other hand, the photosensitive member of the present Example indicated a slightly decaying value of E' of 9.2 lux-sec, but it is no problem in practical use.

These results indicate that the photosensitive member prepared in the present example according to the invention exhibits outstanding performance. When the member was used in the Carlson process for forming images thereon, followed by image transfer, sharp copy images were obtained.

EXAMPLE 8

The photosensitive member was prepared by exactly the same process as in Example 1 except that the flow rate of tetrafluoromethane was set to 1 sccm..

When subjected to CHN quantitative analysis, the a-C layer thus obtained was found to contain 55 atomic % of hydrogen atoms based on the combined amount of carbon atoms and hydrogen atoms. Further, when subjected to auger electron spectroscopy, the a-C layer thus obtained was found to contain 0.1 atomic % of halogen atoms, i.e. fluorine atoms based on all the constituent atoms therein. Moreover, the thickness of the a-C layer was 5 microns.

The ratio of $\alpha_1$ to $\alpha_2$ was measured by the infrared absorption spectrum within the range of 4000 $cm^{-1}$ to 450 $cm^{-1}$ using Infrared Fourier Transform Spectrometer 1710 (made by Perkin-Elmer Co., Ltd.). The obtained ratio of $\alpha_1$ to $\alpha_2$ was about 0.2.

Characteristics:

When the photosensitive member obtained was used for the usual Carlson process, the member showed a Vmax of −550 V. Specifically, the C.A. of the member was 102 V by calculating from the entire thickness of the member, i.e. 5.4 microns, indicating that the member had satisfactory charging properties.

Further, the Td of the member was about 35 seconds, showing that the member had satisfactory charge retentivity.

The E of the member was about 10.5 lux-sec, showing that the member was satisfactory in photosensitive characteristics, though the sensitivity was slightly lower than that of the members shown in Examples 1 to 7.

The E' of the member decayed to 21.2 lux-sec, showing that reduction of the sensitivity was observed after lapse of time.

Further, the photosensitive member was 2.8 in optical energy gap (Egopt) and 2.9 in relative dielectric constant.

These results indicate that the photosensitive member prepared in the present example according to the invention exhibits outstanding performance When the member was used in the Carlson process for forming images thereon, followed by image transfer, sharp copy images were obtained.

COMPARATIVE EXAMPLE 1

The photosensitive member was prepared by exactly the same process as in Example 1 except that tetrafluoromethane was not introduced in CTL step.

When subjected to CHN quantitative analysis, the a-C layer thus obtained was found to contain 55 atomic % of hydrogen atoms based on the combined amount of carbon atoms and hydrogen atoms. Further, when subjected to auger electron spectroscopy, the a-C layer thus obtained was found to contain no halogen atoms, i.e. fluorine atoms. Moreover, the thickness of the a-C layer was 2.5 microns, showing that the film-forming speed was very low.

The ratio of $\alpha_1$ to $\alpha_2$ was measured by the infrared absorption spectrum within the range of 4000 $cm^{-1}$ to 450 $cm^{-1}$ using an Infrared Fourier Transform Spectrometer 1710 (made by Perkin-Elmer Co., Ltd.). The obtained ratio of $\alpha_1$ to $\alpha_2$ was about 0.15.

Characteristics:

When the photosensitive member obtained was used for the usual Carlson process, the member showed a Vmax of −250 V. Specifically, the C.A. of the member was 86 V by calculating from the entire thickness of the member, i.e. 2.9 microns, indicating that the member had satisfactory charging properties.

Further, the Td of the member was about 35 seconds, showing that the member had satisfactory charge retentivity.

However, the E of the member was about 30 lux-sec, so that the member was found unusable.

The E' of the member was not obtained because the member did not attain a half-reduced potential toward light in an amount of 80 lux-sec.

These results indicate that the member shown in Comparative Example 1 is not satisfactory in performance. When the member was used in the Carlson process for forming images thereon, followed by image transfer, fogged copy images only were obtained. Further, the copy images could not be obtained after three months.

EXAMPLE 9

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. 8 was used. First, the interior of the reactor 733 was evacuated to a high vacuum of about $10^{-6}$ torr, and the first regulator valve 707 was thereafter opened to introduce hydrogen gas from the first tank 701 into the first flow controller 713 at an output pressure of 1.0 kg/cm$^2$. At the same time, the seventh and eighth regulator valves 725 and 726 were opened, and stylene gas, heated at a temperature of 90° C. by the first heater 722 and chloroform gas, heated at a temperature of 35° C. by the second heater 723 were introduced into the seventh and eighth flow controllers 728 and 729 from the first and second containers 719 and 720. The dials on the flow controllers were adjusted to supply the hydrogen gas at a flow rate of 200 sccm, the stylene gas at 100 sccm and the chloroform gas at 150 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, which was an aluminum substrate having a diameter of 80 mm and a length of 330 mm, was preheated to 150° C. With the gas flow rates and the pressure in stabilized state, 150-watt power with a frequency of 20 KHz was applied to the power application electrode 736 from the low-frequency power source 741 which was connected to the electrode by the connection selecting switch 744 in advance to conduct plasma polymerization for 1 hour, forming an a-C layer, 20 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 39 atomic % of hydrogen atoms based on the combined amount of carbon atoms and hydrogen atoms. Further, when subjected to auger electron spectroscopy, the a-C layer thus obtained was found to contain 5.3 atomic % of halogen atoms, i.e. chlorine atoms based on all the constituent atoms therein.

Charge Generating Layer Forming Step (CGL):

Next, the first and sixth regulator valves 707 and 712 were opened to introduce hydrogen gas from the first tank 701 into the first flow controller 713 and silane gas from the sixth tank 706 into the sixth flow controller 718, each at an output pressure of 1.0 kg/cm$^2$. The dials on the flow controllers were adjusted to supply the hydrogen gas at a flow rate of 400 sccm and the silane gas at 100 sccm to the reactor 733. After the flows of the gases stabilized, the internal pressure of the reactor 733 was adjusted to 1.0 torr by the pressure control valve 745. On the other hand, the substrate 752 formed with the a-C layer was preheated to 150° C. With the gas flow rates and the pressure in stabilized state, 200-watt power with a frequency of 13.56 MHz was applied to the power application electrode 736 from the high-frequency power source 739 to effect glow discharge for 10 minutes, whereby a charge generating a-Si:H layer was formed with a thickness of 0.4 microns.

Characteristics:

When the photosensitive member obtained was used for the usual Carlson process, the member showed a Vmax of −800 V. Specifically, the C.A. of the member was 39.2 V by calculating from the entire thickness of the member, i.e. 20.4 microns, indicating that the member had satisfactory charging properties.

Further, the Td of the member was about 20 seconds, showing that the member had satisfactory charge retentivity.

The E of the member was about 1.9 lux-sec, showing that the member was satisfactory in photosensitive characteristics.

Further, the photosensitive member was 1.8 in optical energy gap (Egopt) and 3.6 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLES 10 TO 14

The photosensitive members were prepared by exactly the same process as in Example 9 except that the flow rate of chloroform gas was set to 120 (Example 10), 80 (Example 11), 50 (Example 12), 20 (Example 13) 10 (Example 14) sccm.

When subjected to CHN quantitative analysis, the respective a-C layers thus obtained were found to contain 42, 44, 48, 50 and 53 atomic % of hydrogen atoms based on the combined amount of carbon atoms and hydrogen atoms. Further, when subjected to auger electron spectroscopy, the respective a-C layers thus obtained were found to contain 5.0, 4.2, 3.2, 1.5 and 0.7 atomic % of halogen atoms, i.e. chlorine atoms based on all the constituent atoms therein. Moreover, the thicknesses of the respective a-C layers were 18, 17, 14.5, 13 and 10 microns.

Characteristics:

When the photosensitive members obtained were used for the usual Carlson process, the respective members showed a Vmax of −800, −750, −750, −650 and −600 V. Specifically, the C.A. values of the respective members were 43.5, 43.1, 50.3, 48.5 and 57.7 V by calculating from the entire thickness of the respective members, i.e. 18.4, 17.4, 14.9, 13.4 and 10.4 microns, indicating that these members had satisfactory charging properties.

Further, the Td values of the respective members were about 20, 25, 25, 25 and 30 seconds, showing that these members had satisfactory charge retentivity.

The E values of the respective members were about 2.3, 2.4, 2.8, 3.3 and 3.8 lux-sec, showing that these members were satisfactory in photosensitive characteristics Further, the photosensitive members were 1.9, 2.1, 2.3, 2.6 and 2.6 in optical energy gap (Egopt) and 3.5, 3.5, 3.3, 3.2 and 3.2 in relative dielectric constant.

These results indicate that these photosensitive members prepared in the present examples according to the invention exhibit outstanding performance. When these members were used in the Carlson process for forming images thereon, followed by image transfer, sharp copy images were obtained.

EXAMPLE 15

The photosensitive member was prepared by exactly the same process as in Example 9 except that the flow rate of chloroform gas was set to 7 sccm.

When subjected to CHN quantitative analysis, the a-C layer thus obtained was found to contain 53 atomic % of hydrogen atoms based on the combined amount of carbon atoms and hydrogen atoms. Further, when subjected to auger electron spectroscopy, the a-C layer thus obtained was found to contain 0.4 atomic % of halogen atoms, i.e. chlorine atoms based on all the constituent atoms therein. Moreover, the thickness of the a-C layer was 8 microns.

Characteristics:

When the photosensitive member obtained was used for the usual Carlson process, the member showed a Vmax of −600 V. Specifically, the C.A. of the member was 71.4 V by calculating from the entire thickness of the member, i.e. 8.4 microns, indicating that the member had satisfactory charging properties.

Further, the Td of the member was about 30 seconds, showing that the member had satisfactory charge retentivity.

The E of the member was about 7.5 lux-sec. Although the member was slightly lower in photosensitive properties than those of Examples 9 to 14, it was understood that the member was usable without any problem.

The E′ of the member decreased to 0.8 lux-sec., but the member was usable without any problem.

Further, the photosensitive member was 2.8 in optical energy gap (Egopt) and 2.9 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 16

The photosensitive member was prepared by exactly the same process as in Example 9 except that the flow rate of chloroform gas was set to 1 sccm.

When subjected to CHN quantitative analysis, the a-C layer thus obtained was found to contain 54 atomic % of hydrogen atoms based on the combined amount of carbon atoms and hydrogen atoms. Further, when subjected to auger electron spectroscopy, the a-C layer thus obtained was found to contain 0.2 atomic % of halogen atoms, i.e. chlorine atoms based on all the constituent atoms therein. Moreover, the thickness of the a-C layer was 7 microns.

Characteristics:

When the photosensitive member obtained was used for the usual Carlson process, the member showed a Vmax of −600 V. Specifically, the C.A. of the member was 81.1 V by calculating from the entire thickness of the member, i.e. 7.4 microns, indicating that the member had satisfactory charging properties.

Further, the Td of the member was about 30 seconds, showing that the member had satisfactory charge retentivity.

The E of the member was about 12.5 lux-sec. Although the member was slightly lower in photosensitive properties than those of Examples 9 to 15, it was understood that the member was usable without any problem.

The E′ of the member decayed to 27.5 lux-sec. This result shows that a reduction in sensitivity was observed after lapse of time, but the member was usable without any problem.

Further, the photosensitive member was 2.9 in optical energy gap (Egopt) and 3.0 in relative dielectric constant.

These results indicate that the photosensitive member prepared in the present example according to the invention exhibits outstanding performance When the member was used in the Carlson process for forming images thereon, followed by image transfer, sharp copy images were obtained.

COMPARATIVE EXAMPLE 2

The photosensitive member was prepared by exactly the same process as in Example 9 except that chloroform gas was not introduced in CTL step.

When subjected to CHN quantitative analysis, the a-C layer thus obtained was found to contain 54 atomic % of hydrogen atoms based on the combined amount of carbon atoms and hydrogen atoms. Further, when subjected to auger electron spectroscopy, the a-C layer thus obtained was found to contain no halogen atoms, i.e. chlorine atoms. Moreover, the thickness of the a-C layer was 5 microns, showing that the film-forming speed was very low.

Characteristics:

When the photosensitive member obtained was used for the usual Carlson process, the member showed a Vmax of −450 V. Specifically, the C.A. of the member was 83.3 V by calculating from the entire thickness of the member, i.e. 5.4 microns, indicating that the member had satisfactory charging properties.

Further, the Td of the member was about 35 seconds, showing that the member had satisfactory charge retentivity.

However, the E of the member was about 40 lux-sec. This shows that the residual potential rose to about 100 V, so that the member was found unusable.

The E′ of the member was not obtained because the member did not attain a half-reduced potential toward light in an amount of 80 lux-sec.

These results indicate that the member shown in Comparative Example 2 is not satisfactory in performance. When the member was used in the Carlson process for forming images thereon, followed by image transfer, fogged copy images only were obtained. Further, the copy images could not be obtained after three months.

EXAMPLE 17

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. 7 was used. First, the interior of the reactor 733 was evacuated to a high vacuum of about $10^{-6}$ torr, and the first and third regulator valves 707 and 709 were thereafter opened to introduce hydrogen gas from the first tank 701 into the first flow controller 713 and tetrafluoromethane gas from the third tank 703 into the third flow controller 715, each at an output pressure of 1.0 kg/cm$^2$. At the same time, the seventh regulator valve 725 was opened and cyclohexane, heated at a temperature of 45° C. by the first heater 722 was introduced into the seventh flow controller 728 from the first container 719. The dials on the flow controllers were adjusted to supply the hydrogen gas at a flow rate of 40 sccm, the tetrafluoromethane gas at 10 sccm and the cyclohexane gas at 20 sccm to the reactor 733 through the main pipe 732 via the intermediate mixer 731. After the flows of the gases were stabilized, the internal pressure of the reactor 733 was adjusted to 0.6 torr by the pressure control valve 745. On the other hand, the substrate 752, which was an aluminum substrate measuring 50 mm in length, 50 mm in width and 3 mm in thickness, was preheated to 200° C. With the gas flow rates and the pressure in stabilized state, 100-watt power with a frequency of 13.56 MHz was applied to the power application electrode 736 from the high-frequency power source 739 preconnected thereto by the selecting switch 744 to conduct plasma polymerization for 1 hour, forming an a-C layer, 15 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 42 atomic % of hydrogen atoms based on the combined amount of carbon atoms and hydrogen atoms. Further, when subjected to auger electron spectroscopy, the a-C layer thus obtained was found to contain 3.2 atomic % of halogen atoms, i.e. fluorine atoms based on all the constituent atoms therein.

Charge Generating Layer Forming Step (CGL):

Next, the first, fifth and sixth regulator valves 707, 711 and 712 were opened to introduce hydrogen gas from the first tank 701 into the first flow controller 713, diborane gas which was diluted to a concentration of 50 ppm with hydrogen gas into the fifth flow controller 717 from the fifth tank 705 and silane gas from the sixth tank 706 into the sixth flow controller 718, each at an output pressure of 1.0 kg/cm$^2$. The dials on the flow controllers were adjusted to supply the hydrogen gas at a flow rate of 300 sccm, the diborane gas diluted to a concentration of 50 ppm with hydrogen gas at a flow rate of 10 sccm and the silane gas at 180 sccm to the reactor 733. After the flows of the gases stabilized, the internal pressure of the reactor 733 was adjusted to 1.0 torr by the pressure control valve 745. On the other hand, the substrate 752 formed with the a-C layer was preheated to 200° C. With the gas flow rates and the pressure in stabilized state, 200-watt power with a frequency of 13.56 MHz was applied to the power application electrode 736 from the high-frequency power source 739 to effect glow discharge for 20 minutes, whereby a charge generating a-Si:H layer was formed with a thickness of 0.5 microns.

Characteristics:

When the photosensitive member obtained was used for the usual Carlson process, the member showed a Vmax of +600 V. Specifically, the C.A. of the member was 39 V by calculating from the entire thickness of the member, i.e. 15.4 microns, indicating that the member had satisfactory charging properties.

Further, the Td of the member was about 20 seconds, showing that the member had satisfactory charge retentivity.

The E of the member was about 4.1 lux-sec, showing that the member was satisfactory in photosensitive characteristics.

Further, the photosensitive member was 2.7 in optical energy gap (Egopt) and 2.9 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 18

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. 7 was used. First, the interior of the reactor 733 was evacuated to a high vacuum of about $10^{-6}$ torr, and the first and second regulator valves 707 and 708 were thereafter opened to introduce hydrogen gas from the first tank 701 into the first flow controller 713 and butadiene gas from the second tank 702 into the second flow controller 714, each at an output pressure of 1.0 kg/cm$^2$. At the same time, the seventh regulator valve 725 and eighth regulator valve 726 were opened and myrcene, heated at a temperature of 55° C. by the first heater 722 and fluorobenzene, heated at a temperature of 50° C. by the second heater 723 were introduced into the seventh and eighth flow controllers 728 and 729 from the first and second containers 719 and 720. The dials on the flow controllers were adjusted to supply the hydrogen gas at a flow rate of 40 sccm, the butadiene gas at a flow rate of 30 sccm, the myrcene gas at 40 sccm and the fluorobenzene gas at 30 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, which was an aluminum substrate measuring 50 mm in length, 50 mm in width and 3 mm in thickness, was preheated to 200° C. With the gas flow rates and the pressure in stabilized state, 100-watt power with a frequency of 50 KHz was applied to the power application electrode 736 from the low-frequency power source 741 preconnected thereto by the selecting switch 744 to conduct plasma polymerization for 45 minutes, forming an a-C layer, 15 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 37 atomic % of hydrogen atoms based on the combined amount of carbon atoms and hydrogen atoms. Further, when subjected to auger electron spectroscopy, the a-C layer thus obtained was found to contain 8.7 atomic % of halogen atoms, i.e. fluorine atoms based on all the constituent atoms therein.

Charge Generating Layer Forming Step (CGL):

The substrate having the charge transporting layer formed thereon by CTL step was withdrawn from the apparatus, and then was placed into a vacuum evaporation apparatus, in which the layer was coated with Se-As alloy to a thickness of 0.5 microns by resistance heating.

Characteristics:

When the photosensitive member obtained was used for the usual Carlson process, the member showed a Vmax of +650 V. Specifically, the C.A. of the member was 42.2 V by calculating from the entire thickness of the member, i.e. 15.4 microns, indicating that the member had satisfactory charging properties.

Further, the Td of the member was about 25 seconds, showing that the member had satisfactory charge retentivity.

The E of the member was about 2.3 lux-sec, showing that the member was satisfactory in photosensitive characteristics.

Further, the photosensitive member was 1.7 in optical energy gap (Egopt) and 3.0 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 19

The photosensitive member was prepared by exactly the same process as in Example 1 except the CTL step and CGL step in Example 1 were reversed in order.

Characteristics:

When the photosensitive member obtained was used for the usual Carlson process, the member showed a Vmax of +750 V. Specifically, the C.A. of the member was 45.7 V by calculating from the entire thickness of the member, i.e. 16.4 microns, indicating that the member had satisfactory charging properties.

Further, the Td of the member was about 20 seconds, showing that the member had satisfactory charge retentivity.

The E of the member was about 4.2 lux-sec, showing that the member was satisfactory in photosensitive characteristics.

Further, the photosensitive member was 2.0 in optical energy gap (Egopt) and 3.5 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 20

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. 7 was used. First, the interior of the reactor 733 was evacuated to a high vacuum of about $10^{-6}$ torr, and the first and second regulator valves 707 and 708 were thereafter opened to introduce hydrogen gas from the first tank 701 into the first flow controller 713 and ethylene gas from the second tank 702 into the second flow controller 714, each at an output pressure of 1.0 kg/cm$^2$. At the same time, the seventh regulator valve 725 and was opened and 1H,1H,5H-octafluoropentylmethacrylate, i.e., $CH_3{=}C(CH_3)COOCH_2(CF_2)_4H$, heated at a temperature of 55° C. by the first heater 722 was introduced into the seventh flow controller 728 from the first container 719. The dials on the flow controllers were adjusted to supply the hydrogen gas at a flow rate of 40 sccm, the ethylene gas at a flow rate of 70 sccm and the 1H,1H,5H-octafluoropentylmethacrylate gas at 10 sccm to the reactor 733 through the main pipe 732 via the intermediate mixer 731. After the flows of the gases were stabilized, the internal pressure of the reactor 733 was adjusted to 0.8 torr by the pressure control valve 745. On the other hand, the substrate 752, which was an aluminum substrate measuring 50 mm in length, 50 mm in width and 3 mm in thickness, was preheated to 200° C. With the gas flow rates and the pressure in stabilized state, 100-watt power with a frequency of 50 KHz was applied to the power application electrode 736 from the low-frequency power source 741 preconnected thereto by the selecting switch 744 to conduct plasma polymerization for 1 hour, forming an a-C layer, 20 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 48 atomic % of hydrogen atoms based on the combined amount of carbon atoms and hydrogen atoms. Further, when subjected to auger electron spectroscopy, the a-C layer thus obtained was found to contain 6.6 atomic % of halogen atoms, i.e. fluorine atoms based on all the constituent atoms therein.

CGL (a-Si) Step:

The a-Si:H charge generating layer having a thickness of 0.4 microns was subsequently formed in the same manner as in Example 1.

Characteristics:

When the photosensitive member obtained was used for the usual Carlson process, the member showed a Vmax of +750 V. Specifically, the C.A. of the member was 36.8 V by calculating from the entire thickness of the member, i.e. 20.4 microns, indicating that the member had satisfactory charging properties.

Further, the Td of the member was about 20 seconds, showing that the member had satisfactory charge retentivity.

The E of the member was about 2.0 lux-sec, showing that the member was satisfactory in photosensitive characteristics.

Further, the photosensitive member was 2.1 in optical energy gap (Egopt) and 3.2 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 21

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. 7 was used. First, the interior of the reactor 733 was evacuated to a high vacuum of about $10^{-6}$ torr, and the seventh and eighth regulator valves 725 and 726 were thereafter opened to introduce 1H,1H,5H-octafluoropentylmethacrylate gas, heated at a temperature of 55° C. by the first heater 722 into the seventh flow controller 728 from the first container 719 and stylene gas, heated at a temperature of 60° C. by the second heater 723 into the eighth flow controller 729 from the second container 720. The dials on the flow controllers were adjusted to supply the 1H,1H,5H-octafluoropentylmethacrylate gas at 20 sccm and stylene gas at 70 sccm to the reactor 733 through the main pipe 732 via the intermediate mixer 731. After the flows of the gases were stabilized, the internal pressure of the reactor 733 was adjusted to 0.9 torr by the pressure control valve 745. On the other hand, the substrate 752, which was an aluminum substrate measuring 50 mm in length, 50 mm in width and 3 mm in thickness, was preheated to 100° C. With the gas flow rates and the pressure in stabilized state, 150-watt power with a frequency of 30 KHz was applied to the power application electrode 736 from the low-frequency power source 741 preconnected thereto by the selecting switch 744 to conduct plasma polymerization for 30 minutes, forming an a-C layer, 25 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 44 atomic % of hydrogen atoms based on the combined amount of carbon atoms and hydrogen atoms. Further, when subjected to auger electron spectroscopy, the a-C layer thus obtained was found to contain 5.7 atomic % of halogen atoms, i.e. fluorine atoms based on all the constituent atoms therein.

CGL (a-Si) Step:

The a-Si:H charge generating layer having a thickness of 0.4 microns was subsequently formed n the same manner as in Example 1.

Characteristics:

When the photosensitive member obtained was used for the usual Carlson process, the member showed a Vmax of +700 V. Specifically, the C.A. of the member was 27.6 V by calculating from the entire thickness of the member, i.e. 25.4 microns, indicating that the member had satisfactory charging properties.

Further, the Td of the member was about 25 seconds, showing that the member had satisfactory charge retentivity.

The E of the member was about 2.8 lux-sec, showing that the member was satisfactory in photosensitive characteristics.

Further, the photosensitive member was 1.9 in optical energy gap (Egopt) and 2.9 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 22

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The low discharge decomposition apparatus shown in FIG. 7 was used. First, the interior of the reactor 733 was evacuated to a high vacuum of about $10^{-6}$ torr, and the seventh and eighth regulator valves 725 and 726 were thereafter opened to introduce 1H,1H,5H-octafluoropentylmethacrylate gas, heated at a temperature of 55° C. by the first heater 722 into the seventh flow controller 728 from the first container 719 and myrcene gas, heated at a temperature of 55° C. by the second heater 723 into the eighth flow controller 729 from the second container 720. The dials on the flow controllers were adjusted to supply the flow rate of 1H,1H,5H-octafluoropentylmethacrylate gas at 10 sccm and myrcene gas at 30 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, which was an aluminum substrate measuring 50 mm in length, 50 mm in width and 3 mm in thickness, was preheated to 150° C. With the gas flow rates and the pressure in stabilized state, 150-watt power with a frequency of 30 KHz was applied to the power application electrode 736 from the low-frequency power source 741 preconnected thereto by the selecting switch 744 to conduct plasma polymerization for 30 minutes, forming an a-C layer, 18 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 38 atomic % of hydrogen atoms based on the combined amount of carbon atoms and hydrogen atoms. Further, when subjected to auger electron spectroscopy, the a-C layer thus obtained was found to contain 6.2 atomic % of halogen atoms, i.e. fluorine atoms based on all the constituent atoms therein.

CGL (a-Si) Step:

The a-Si:H charge generating layer having a thickness of 0.4 microns was subsequently formed in the same manner as in Example 1.

Characteristics:

When the photosensitive member obtained was used for the usual Carlson process, the member showed a Vmax of +750 V. Specifically, the C.A. of the member was 40.8 V by calculating from the entire thickness of the member, i.e. 18.4 microns, indicating that the member had satisfactory charging properties.

Further, the Td of the member was about 20 seconds, showing that the member had satisfactory charge retentivity.

The E of the member was about 1.7 lux-sec, showing that the member was satisfactory in photosensitive characteristics.

Further, the photosensitive member was 1.8 in optical energy gap (Egopt) and 3.0 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 23

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. 7 was used. First, the interior of the reactor 733 was evacuated to a high vacuum of about $10^{-6}$ torr, and the fourth regulator valve 710 was thereafter opened to introduce argon gas from the fourth tank 704 into the fourth flow controller 716 at an output pressure of 1.0 kg/cm$^2$. At the same time, the ninth regulator valve 727 was opened and 2,2,2-trifluoroethylmethacrylate, heated at a temperature of 40° C. by the third heater 724 was introduced into the ninth flow controller 730 from the third container 721. The dials on the flow controllers were adjusted to supply the argon gas at a flow rate of 40 sccm and the 2,2,2-trifluoroethylmethacrylate gas at a flow rate of 30 sccm to the reactor 733 through the main pipe 732 via the intermediate mixer 731. After the flows of the gases were stabilized, the internal pressure of the reactor 733 was adjusted to 0.3 torr by the pressure control valve 745. On the other hand, the substrate 752, which was an aluminum substrate measuring 50 mm in length, 50 mm in width and 3 mm in thickness, was preheated to 200° C. With the gas flow rates and the pressure in stabilized state, 200-watt power with a frequency of 13.56 MHz was applied to the power application electrode 736 from the high-frequency power source 739 preconnected thereto by the selecting switch 744 to conduct plasma polymerization for 5 hours, forming an a-C layer, 15 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 37 atomic % of hydrogen atoms based on the combined amount of carbon atoms and hydrogen atoms. Further, when subjected to auger electron spectroscopy, the a-C layer thus obtained was found to contain 10 atomic % of halogen atoms, i.e. fluorine atoms and 7 atomic % of oxygen atoms based on all the constituent atoms therein.

CGL (a-Si) Step:

The a-Si:H charge generating layer having a thickness of 0.4 microns was subsequently formed in the same manner as in Example 1 except that the substrate was heated at 200° C.

Characteristics:

When the photosensitive member obtained was used for the usual Carlson process, the member showed a Vmax of −600 V. Specifically, the C.A. of the member was 39 V by calculating from the entire thickness of the member, i.e. 15.4 microns, indicating that the member had satisfactory charging properties.

Further, the Td of the member was about 15 seconds, showing that the member had satisfactory charge retentivity.

The E of the member was about 1.7 lux-sec, showing that the member was satisfactory in photosensitive characteristics.

Further, the photosensitive member was 1.6 in optical energy gap (Egopt) and 3.1 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 24

The photosensitive member was prepared by the same manner as in Example 23 except that 2,2,3,3-tetrafluoropropylmethacrylate, i.e. $CH_2{=}C(CH_3)COOCH_2(CF_2)_2H$ was introduced instead of 2,2,2-trifluoroethylmethacrylate and the temperature of the third heater 724 was set to 50° C.

When subjected to CHN quantitative analysis, the a-C layer thus obtained was found to contain 34 atomic % of hydrogen atoms based on the combined amount of carbon atoms and hydrogen atoms. Further, when subjected to auger electron spectroscopy, the a-C layer thus obtained was found to contain 15 atomic % of halogen atoms, i.e. fluorine atoms and 5.5 atomic % of oxygen atoms based on all the constituent atoms therein. Moreover, the thickness of the member was 22 microns.

Characteristics:

When the photosensitive member obtained was used for the usual Carlson process, the member showed a Vmax of −550 V. Specifically, the C.A. of the member was 24.6 V by calculating from the entire thickness of the member, i.e. 22.4 microns, indicating that the member had satisfactory charging properties.

Further, the Td of the member was about 15 seconds, showing that the member had satisfactory charge retentivity.

The E of the member was about 4.2 lux-sec, showing that the member was satisfactory in photosensitive characteristics.

When the Td was remeasured after three months (hereinafter referred to as Td′), the photosensitive member shown in Example 23 indicated a value equal to its original value, whereas the present member showed a value of about 10 minutes Although the member exhibited slight reduction of charge retentivity, it was usable without any problem.

Further, the photosensitive member was 1.6 in optical energy gap (Egopt) and 2.8 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 25

The photosensitive member was prepared by the same manner as in Example 23 except that 1H,1H,5H-octafluoropentylmethacrylate, i.e. $CH_2{=}C(CH_3)COOCH_2(CF_2)_4H$ was introduced instead of 2,2,2-trifluoroethylmethacrylate and the temperature of the third heater 724 was set to 60° C.

When subjected to CHN quantitative analysis, the a-C layer thus obtained was found to contain 30 atomic % of hydrogen atoms based on the combined amount of carbon atoms and hydrogen atoms. Further, when subjected to auger electron spectroscopy, the a-C layer thus obtained was found to contain 25 atomic % of halogen atoms, i.e. fluorine atoms and 0.2 atomic % of oxygen atoms based on all the constituent atoms therein. Moreover, the thickness of the member was 25 microns.

The ratio of $\alpha_1$ to $\alpha_2$ was measured by the infrared absorption spectrum within the range of 4000 $cm^{-1}$ to 450 $cm^{-1}$ using an Infrared Fourier Transform Spectrometer 1710 (made by Perkin-Elmer Co., Ltd.). The obtained ratio of $\alpha_1$ to $\alpha_2$ was about 1.0.

Characteristics:

When the photosensitive member obtained was used for the usual Carlson process, the member showed a Vmax of −500 V. Specifically, the C.A. of the member was 20.4 V by calculating from the entire thickness of the member, i.e. 25.4 microns. Although the member was slightly lower in charging ability than those of Examples 17 and 18, it was understood that the member was usable without any problem.

Further, the Td of the member was about 10 seconds. Although this value was slightly lower than that of Example 23, it was understood that the member had satisfactory charge retentivity.

The E of the member was about 3.9 lux-sec, showing that the member was satisfactory in photosensitive characteristics.

Further, the photosensitive member was 1.5 in optical energy gap (Egopt) and 2.9 in relative dielectric constant.

These results indicate that the photosensitive member prepared in the present example according to the invention exhibits outstanding performance. When the member was used in the Carlson process for forming images thereon, followed by image transfer, sharp copy images were obtained.

COMPARATIVE EXAMPLE 3

The photosensitive member was prepared by the same manner as in Example 23 except that 1H,1H,2H,2H-heptafluorodesylmethacrylate, i.e. $CH_2{=}C(CH_3)COOCH_2(CF_2)_8H$ was introduced instead of 2,2,2-trifluoroethylmethacrylate and the temperature of the third heater 724 was set to 70° C.

The a-C layer thus obtained was partly separated and was poor in ability of film-forming. When only the part of the member where the layer was firmly formed was subjected to CHN quantitative analysis, the a-C layer thus obtained was found to contain 28 atomic % of hydrogen atoms based on the combined amount of carbon atoms and hydrogen atoms. Further, when subjected to auger electron spectroscopy, the a-C layer thus obtained was found to contain 28 atomic % of halogen atoms, i.e. fluorine atoms based on all the constituent atoms therein. Oxygen atoms were not found in the a-C layer. Moreover, the thickness of the member was 27 microns.

The ratio of $\alpha_1$ to $\alpha_2$ was measured by the infrared absorption spectrum within the range of 4000 $cm^{-1}$ to 450 $cm^{-1}$ using Infrared Fourier Transform Spectrometer 1710 (made by Perkin-Elmer Co , Ltd.). The obtained ratio of $\alpha_1$ to $\alpha_2$ was about 2.8.

Characteristics:

When the photosensitive member obtained was used for the usual Carlson process, the member showed a Vmax of −350 V. Specifically, the C.A. of the member was 12.8 V by calculating from the entire thickness of the member, i.e. 27.4 microns, indicating that the member was low in charging properties.

Further, the Td of the member was about 3 seconds, showing that the member was low in charge retentivity.

The quantity of light required for light decay from −350 V to −100 V was 4.8 lux-sec., showing that the member had satisfactory photosensitive characteristics.

However, the T′ of the member did not reach 1 second, indicating that the member exhibited much reduction of charge retentivity after lapse of time.

These results indicate that the member shown in Comparative Example 4 is not satisfactory in performance. Further, the member was very poor in ability for film-forming.

EXAMPLE 26

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. 7 was used. First, the interior of the reactor 733 was evacuated to a high vacuum of about $10^{-6}$ torr, and the first, second, third and fourth regulator valves 707, 708, 709 and 710 were thereafter opened to introduce hydrogen gas from the first tank 701 into the first flow controller 713, acetylene gas from the second tank 702 into the second flow controller 714, tetrafluoromethane gas from the third tank 703 into the third flow controller 715 and nitrous oxide gas from the fourth tank 704 into the fourth flow controller 716, each at an output pressure of 1.0 kg/$cm^2$. The dials on the flow controllers were adjusted to supply the hydrogen gas at a flow rate of 40 sccm, the acetylene gas at 40 sccm, the tetrafluoromethane gas at 120 sccm and the nitrous oxide gas at 40 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, which was an aluminum substrate measuring 50 mm in length, 50 mm in width and 3 mm in thickness, was preheated to 200° C. With the gas flow rates and the pressure in stabilized state, 200-watt power with a frequency of 13.56 MHz was applied to the power application electrode 736 from the high-frequency power source 739 preconnected thereto by the selecting switch 744 to conduct plasma polymerization for 5 hours, forming an a-C layer, 20 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 44 atomic % of hydrogen atoms based on the combined amount of carbon atoms and hydrogen atoms. Further, when subjected to auger electron spectroscopy, the a-C layer thus obtained was found to contain 4.1 atomic % of halogen atoms, i.e. fluorine atoms, 1.5 atomic of oxygen atoms and 1.2 atomic % of nitrogen atoms based on all the constituent atoms therein.

The ratios of $\alpha_1$ to $\alpha_2$ and $\alpha_3$ to $\alpha_4$ were measured by the infrared absorption spectrum within the range of 4000 $cm^{-1}$ to 450 $cm^{-1}$ using an Infrared Fourier Transform Spectrometer 1710 (made by Perkin-Elmer Co., Ltd.). The obtained ratio of $\alpha_1$ to $\alpha_2$ was about 0.82 and $\alpha_3$ to $\alpha_4$ was about 0.63.

Charge Generating Layer Forming Step (CGL):

Next, the first and sixth regulator valves 707 and 712 were opened to introduce hydrogen gas from the first tank 701 into the first flow controller 713 and silane gas from the sixth tank 706 into the sixth flow controller 718, each at an output pressure of 1.0 $kg/cm^2$. The dials on the flow controllers were adjusted to supply the hydrogen gas at a flow rate of 100 sccm and the silane gas at 60 sccm to the reactor 733. After the flows of the gases stabilized, the internal pressure of the reactor 733 was adjusted to 1.0 torr by the pressure control valve 745. On the other hand, the substrate 752 formed with the a-C layer was preheated to 200° C. With the gas flow rates and the pressure in stabilized state, 100-watt power with a frequency of 13.56 MHz was applied to the power application electrode 736 from the high-frequency power source 739 to effect glow discharge for 20 minutes, whereby a charge generating a-Si:H layer was formed with a thickness of 0.4 microns.

Characteristics:

When the photosensitive member obtained was used for the usual Carlson process, the member showed a Vmax of −600 V. Specifically, the C.A. of the member was 29.4 V by calculating from the entire thickness of the member, i.e. 20.4 microns, indicating that the member had satisfactory charging properties.

Further, the Td of the member was about 15 seconds, showing that the member had satisfactory charge retentivity.

The E of the member was about 1.8 lux-sec, showing that the member was satisfactory in photosensitive characteristics.

When the member was exposed to white light of 80 lux-sec., the surface potential was measured as a residual potential (hereinafter referred to as Vr) to −15 V.

Further, Vmax was remeasured three months after formation (This value is hereinafter referred to as Vmax'). The member showed Vmax' of −580 V, indicating that the member retained excellent chargeability after lapse of time.

The Td' of the member was about 15 seconds, showing that the member retained satisfactory charge retentivity after lapse of time.

When the Vr of the member was remeasured three months after formation (This value is hereinafter referred to as Vr'), the member showed Vr' of −12 V. The E' of the member was 1.7 lux-sec. These results showed that the member retained excellent photosensitive characteristics after lapse of time.

Further, the photosensitive member was 1.8 in optical energy gap (Egopt) and 3.6 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLES 27 TO 30

The photosensitive members were prepared by exactly the same process as in Example 26 except that the flow rates of tetrafluoromethane gas were set to 80 (Example 27), 45 (Example 28), 20 (Example 29), and 6 (Example 30) sccm.

When subjected to CHN quantitative analysis, the respective a-C layers thus obtained were found to contain 44, 45, 46 and 50 atomic % of hydrogen atoms based on the combined amount of carbon atoms and hydrogen atoms Further, when subjected to auger electron spectroscopy, the respective a-C layers thus obtained were found to contain 3.4, 2.5, 1.5 and 0.5 atomic % of halogen atoms, i.e. fluorine atoms, 1.5, 1.4, 1.3 and 1.3 atomic % of oxygen atoms and 1.2, 1.0, 1.1 and 1.0 atomic % of nitrogen atoms based on all the constituent atoms therein. Moreover, the thicknesses of the respective a-C layers were 18, 15.5, 13 and 10 microns.

Characteristics:

When the photosensitive members obtained were used for the usual Carlson process, the respective members showed a Vmax of −600, −650, −650 and −650 V. Specifically, the C.A. of the respective members were 32.6, 40.9, 48.5 and 62.5 V by calculating from the entire thickness of the respective members, i.e. 18.4, 15.9, 13.4 and 10.4 microns, indicating that these members had satisfactory charging properties.

Further, the Td of the respective members were about 15, 20, 20 and 20 seconds, showing that these members had satisfactory charge retentivity.

The E of the respective members were about 1.9, 2.5, 2.7, and 3.0 lux-sec, showing that these members were satisfactory in photosensitive characteristics. Further, the photosensitive members were 1.9, 2.1, 2.4 and 2.5 in optical energy gap (Egopt) and 3.4, 3.0, 2.9 and 3.0 in relative dielectric constant.

The Vr values of the members were −10, −15, −15 and −10 V.

These results indicate that these photosensitive members prepared in the present examples according to the invention exhibit outstanding performance. When these members were used in the Carlson process for forming images thereon, followed by image transfer, sharp copy images were obtained.

EXAMPLE 31

The photosensitive member was prepared by exactly the same process as in Example 26 except that the flow rate of tetrafluoromethane gas was set to 4 sccm.

When subjected to CHN quantitative analysis, the a-C layer thus attained was found to contain 53 atomic % of hydrogen atoms based on the combined amount of carbon atoms and hydrogen atoms. Further, when subjected to auger electron spectroscopy, the a-C layer thus obtained was found to contain 0.3 atomic % of halogen atoms, i.e. fluorine atoms, 1.2 atomic of oxygen atoms and 1.1 atomic % of nitrogen atoms based on all the constituent atoms therein. Moreover, the thickness of the a-C layer was 8 microns.

Characteristics:

When the photosensitive member obtained was used for the usual Carlson process, the member showed a Vmax of −600 V. Specifically, the C.A. of the member was 71.4 V by calculating from the entire thickness of the member, i e. 8.4 microns, indicating that the member had satisfactory charging properties.

Further, the Td of the member was about 25 seconds, showing that the member had satisfactory charge retentivity.

The E of the member was about 5.9 lux-sec. Although the member was slightly lower in photosensitive properties than those of Examples 26 to 30, it was understood that the member was usable without any problem.

The E′ of the member decayed to 9.2 lux-sec. This result shows that a reduction in sensitivity was observed after lapse of time, but the member was usable without any problem.

Further, the photosensitive member was 2.5 in optical energy gap (Egopt) and 3.0 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 32

The photosensitive member was prepared by exactly the same process as in Example 26 except that the flow rate of tetrafluoromethane gas was set to 1 sccm.

When subjected to CHN quantitative analysis, the a-C layer thus obtained was found to contain 54 atomic % of hydrogen atoms based on the combined amount of carbon atoms and hydrogen atoms. Further, when subjected to auger electron spectroscopy, the a-C layer thus obtained was found to contain 0.1 atomic % of halogen atoms, i.e. fluorine atoms, 1.2 atomic % of oxygen atoms and 1.2 atomic % of nitrogen atoms based on all the constituent atoms therein Moreover, the thickness of the a-C layer was 7 microns.

Characteristics:

When the photosensitive member obtained was used for the usual Carlson process, the member showed a Vmax of −550 V. Specifically, the C.A. of the member was 74.3 V by calculating from the entire thickness of the member, i.e. 7.4 microns, indicating that the member had satisfactory charging properties.

Further, the Td of the member was about 25 seconds, showing that the member had satisfactory charge retentivity.

The E of the member was about 11.1 lux-sec. Although the member was slightly lower in photosensitive properties than those of Examples 26 to 31, it was understood that the member was usable without any problem.

The E′ of the member decayed to 23 lux-sec. This result shows that a reduction in sensitivity was observed after lapse of time, but the member was usable without any problem.

Further, the photosensitive member was 2.7 in optical energy gap (Egopt) and 2.9 in relative dielectric constant.

These results indicate that the photosensitive member prepared in the present example according to the invention exhibits outstanding performance. When the member was used in the Carlson process for forming images thereon, followed by image transfer, sharp copy images were obtained.

COMPARATIVE EXAMPLE 4

The photosensitive member was prepared by exactly the same process as in Example 26 except that the flow rate of tetrafluoromethane gas was set to 0.2 sccm.

When subjected to CHN quantitative analysis, the a-C layer thus obtained was found to contain 55 atomic % of hydrogen atoms based on the combined amount of carbon atoms and hydrogen atoms. Further, when subjected to auger electron spectroscopy, the a-C layer thus obtained was found to contain 1.2 atomic % of oxygen atoms and 1.1 atomic % of nitrogen atoms based on all the constituent atoms therein. On the other hand, fluorine atoms were found to be contained in a trace amount, i.e., less than 0.1 atomic %. Moreover, the thickness of the a-C layer was 5 microns.

Characteristics:

When the photosensitive member obtained was used for the usual Carlson process, the member showed a Vmax of −400 V. Specifically, the C.A. of the member was 74.1 V by calculating from the entire thickness of the member, i.e. 5.4 microns, indicating that the member had satisfactory charging properties.

Further, the Td of the member was about 30 seconds, showing that the member had satisfactory charge retentivity.

However, the E of the member was about 18.7 lux-sec and Vr was −40 V. This shows that the member was found unusable.

The E′ of the member was not obtained because the member did not attain a half-reduced potential toward light in an amount of 80 lux-sec and the Vr′ was −350 V.

These results indicate that the member shown in Comparative Example 4 is not satisfactory in performance. When the member was used in the Carlson process for forming images thereon, followed by image transfer, fogged copy images only were obtained. Further, copy images could not be obtained after three months. This substantiates the effect of the a-C layer of the invention prepared by doping halogen atoms.

EXAMPLE 33

The photosensitive member was prepared by exactly the same process as in Example 30 except that the flow rate of nitrous oxide gas was set to 5 sccm.

When subjected to CHN quantitative analysis, the a-C layer thus obtained was found to contain 50 atomic % of hydrogen atoms based on the combined amount of carbon atoms and hydrogen atoms. Further, when subjected to auger electron spectroscopy, the a-C layer thus obtained was found to contain 0.5 atomic % of halogen atoms, i.e. fluorine atoms, 0.2 atomic % of oxygen atoms and 0.15 atomic % of nitrogen atoms based on all the constituent atoms therein Moreover, the thickness of the a-C layer was 9.5 microns.

Characteristics:

When the photosensitive member obtained was used for the usual Carlson process, the member showed a Vmax of −650 V. Specifically, the C.A. of the member was 65.7 V by calculating from the entire thickness of the member, i.e. 9.9 microns, indicating that the member had satisfactory charging properties.

Further, the Td of the member was about 20 seconds, showing that the member had satisfactory charge retentivity.

The E of the member was about 2.9 lux-sec and Vr was about −10 V, showing that the member was satisfactory in photosensitive characteristics.

On the other hand, the Vmax' was −550 V, C.A.' was 55.6 and Td' was 8 seconds. Although the member exhibited a slight deterioration after lapse of time due to decreasing amount of oxygen, it was understood that the member was usable without any problem.

Further, the photosensitive member was 2.3 in optical energy gap (Egopt) and 2.9 in relative dielectric constant.

These results indicate that the photosensitive member prepared in the present example according to the invention exhibits outstanding performance. When the member was used in the Carlson process for forming images thereon, followed by image transfer, sharp copy images were obtained.

COMPARATIVE EXAMPLE 5

The photosensitive member was prepared by exactly the same process as in Example 30 except that the nitrous oxide gas was not introduced in CTL step.

When subjected to CHN quantitative analysis, the a-C layer thus obtained was found to contain 51 atomic % of hydrogen atoms based on the combined amount of carbon atoms and hydrogen atoms. Further, when subjected to auger electron spectroscopy, the a-C layer thus obtained was found to contain 0.5 atomic % of halogen atoms, i.e., fluorine atoms based on all the constituent atoms therein, but oxygen and nitrogen atoms were not found therein. Moreover, the thickness of the a-C layer was 10 microns.

Characteristics:

When the photosensitive member obtained was used for the usual Carlson process, the member showed a Vmax of −650 V. Specifically, the C.A. of the member was 62.5 V by calculating from the entire thickness of the member, i.e. 10.4 microns, indicating that the member had satisfactory charging properties.

Further, the Td of the member was about 20 seconds, showing that the member had satisfactory charge retentivity.

The E of the member was about 3.2 lux-sec and Vr was −10 V. This shows that the member was found unusable.

However, the Vmax' of the member was −350 V, C.A.' was −33.7 V and Td' was 3 seconds. This indicated that the member showed a remarkable deterioration in charging ability after lapse of time due to release of oxygen.

These results indicate that the member shown in Comparative Example 5 is not satisfactory in performance. When the member was used in the Carlson process for forming images thereon, followed by image transfer, fogged copy images only were obtained. Further, copy images could not be obtained after three months, though copying operation was carried out with high output of the charger.

EXAMPLE 34

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. 7 was used. First, the interior of the reactor 733 was evacuated to a high vacuum of about $10^{-6}$ torr, and the first, second and third regulator valves 707, 708 and 709 were thereafter opened to introduce hydrogen gas from the first tank 701 into the first flow controller 713, acetylene gas from the second tank 702 into the second flow controller 714 and tetrafluoromethane gas from the third tank 703 into the third flow controller 715, each at an output pressure of 1.0 kg/cm$^2$. At the same time, the seventh regulator valve 725 was opened and cyclohexanone, heated at a temperature of 85° C. by the first heater 722 was introduced into the seventh flow controller 728 from the first container 719. The dials on the flow controllers were adjusted to supply the hydrogen gas at a flow rate of 40 sccm, acetylene gas at 40 sccm, the tetrafluoromethane gas at 120 sccm and the cyclohexanone gas at 30 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, which was an aluminum substrate measuring 50 mm in length, 50 mm in width and 3 mm in thickness, was preheated to 200° C. With the gas flow rates and the pressure in stabilized state, 200-watt power with a frequency of 30 KHz was applied to the power application electrode 736 from the low-frequency power source 741 preconnected thereto by the selecting switch 744 to conduct plasma polymerization for 45 minutes, forming an a-C layer, 23 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 38 atomic % of hydrogen atoms based on the combined amount of carbon atoms and hydrogen atoms. Further, when subjected to auger electron spectroscopy, the a-C layer thus obtained was found to contain 3.7 atomic % of halogen atoms, i.e. fluorine atoms and 7.0 atomic % of oxygen atoms based on all the constituent atoms therein.

The ratios of $\alpha_1$ to $\alpha_2$ and $\alpha_3$ to $\alpha_4$ were measured by the infrared absorption spectrum within the range of 4000 cm$^{-1}$ to 450 cm$^{-1}$ using an Infrared Fourier Transform Spectrometer 1710 (made by Perkin-Elmer Co., Ltd.). The obtained ratio of $\alpha_1$ to $\alpha_2$ was about 0.74 and $\alpha_3$ to $\alpha_4$ was about 1.0.

CGL (a-Si) Step:

The a-Si:H charge generating layer having a thickness of 0.4 microns was subsequently formed by the same method as in Example 26.

Characteristics:

When the photosensitive member obtained was used for the usual Carlson process, the member showed a Vmax of −650 V. Specifically, the C.A. of the member was 27.8 V by calculating from the entire thickness of the member, i.e. 23.4 microns, indicating that the member had satisfactory charging properties.

Further, the Td of the member was about 30 seconds, showing that the member had satisfactory charge retentivity.

The E of the member was about 8.7 lux-sec. Although the member was slightly lower in sensitivity than those of Examples 26 to 30 due to the increasing amount of oxygen, it was understood that the member was usable without any problem. Vr was about −30 V, but it was understood that the member was usable without any problem.

The E′ of the member decayed to 11.1 lux-sec., but it was understood that the member was usable without any problem.

Further, the photosensitive member was 2.3 in optical energy gap (Egopt) and 3.0 in relative dielectric constant.

These results indicate that the photosensitive member prepared in the present example according to the invention exhibits outstanding performance. When the member was used in the Carlson process for forming images thereon with exposure light in a high amount, followed by image transfer, sharp copy images were obtained.

COMPARATIVE EXAMPLE 6

The photosensitive member was prepared by exactly the same process as in Example 34 except that the flow rate of cyclohexanone gas was set to 60 sccm and the temperature of the first heater 722 was set to 90° C.

When subjected to CHN quantitative analysis, the a-C layer thus obtained was found to contain 37 atomic % of hydrogen atoms based on the combined amount of carbon atoms and hydrogen atoms. Further, when subjected to auger electron spectroscopy, the a-C layer thus obtained was found to contain 3.4 atomic % of halogen atoms, i.e., fluorine atoms, and 10.3 atomic % of oxygen atoms based on all the constituent atoms therein. Moreover, the thickness of the a-C layer was 22 microns.

The ratios of $\alpha_1$ to $\alpha_2$ and $\alpha_3$ to $\alpha_4$ were measured by the infrared absorption spectrum within the range of 4000 $cm^{-1}$ to 450 $cm^{-1}$ using an Infrared Fourier Transform Spectrometer 1710 (made by Perkin-Elmer Co., Ltd.). The obtained ratio of $\alpha_1$ to $\alpha_2$ was about 0.72 and $\alpha_3$ to $\alpha_4$ was about 1.4.

Characteristics:

When the photosensitive member obtained was used for the usual Carlson process, the member showed a Vmax of −750 V. Specifically, the C.A. of the member was 33.5 V by calculating from the entire thickness of the member, i.e. 22.4 microns, indicating that the member had satisfactory charging properties.

Further, the Td of the member was about 33 seconds, showing that the member had satisfactory charge retentivity.

However, the E of the member was about 0.3 lux-sec and Vr was −100 V. This shows that the member was low in sensitivity and found unusable.

These results indicate that the member shown in Comparative Example 6 is not satisfactory in performance.

EXAMPLE 35

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. 7 was used. First, the interior of the reactor 733 was evacuated to a high vacuum of about $10^{-6}$ torr, and the third and fourth regulator valves 709 and 710 were thereafter opened to introduce oxygen gas from the third tank 703 into the third flow controller 715 and argon gas from the fourth tank 704 into the fourth flow controller 716, each at an output pressure of 1.0 kg/$cm^2$. At the same time, the seventh and ninth regulator valves 725 and 727 were opened and stylene, heated at 60° C. by the first heater 722 was introduced into the seventh flow controller 728 from the first container 719 and 2,2,2-trifluoroethylmethacrylate, heated at a temperature of 40° C. by the third heater 724 was introduced into the ninth flow controller 730 from the third container 721. The dials on the flow controllers were adjusted to supply the oxygen gas at a flow rate of 20 sccm, argon gas at a flow rate of 40 sccm, stylene gas at 40 sccm and the 2,2,2-trifluoroethylmethacrylate gas at a flow rate of 30 sccm to the reactor 733 through the main pipe 732 via the intermediate mixer 731. After the flows of the gases were stabilized, the internal pressure of the reactor 733 was adjusted to 0.5 torr by the pressure control valve 745. On the other hand, the substrate 752, which was an aluminum substrate measuring 50 mm in length, 50 mm in width and 3 mm in thickness, was preheated to 100° C. With the gas flow rates and the pressure in stabilized state, 150-watt power with a frequency of 40 KHz was applied to the power application electrode 736 from the low-frequency power source 741 preconnected thereto by the selecting switch 744 to conduct plasma polymerization for 1 hour, forming an a-C layer, 14 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 38 atomic % of hydrogen atoms based on the combined amount of carbon atoms and hydrogen atoms. Further, when subjected to auger electron spectroscopy, the a-C layer thus obtained was found to contain 10 atomic % of halogen atoms, i.e. fluorine atoms and 5.1 atomic % of oxygen atoms based on all the constituent atoms therein CGL (a-Si) Step:

The a-Si:H charge generating layer having a thickness of 0.4 microns was subsequently formed by the same method as in Example 23.

Characteristics:

When the photosensitive member obtained was used for the usual Carlson process, the member showed a Vmax of −700 V. Specifically, the C.A. of the member was 48.6 V by calculating from the entire thickness of the member, i.e. 14.4 microns, indicating that the member had satisfactory charging properties.

Further, the Td of the member was about 15 seconds, showing that the member had satisfactory charge retentivity.

The E of the member was about 1.8 lux-sec and Vr was about −15 V, showing that the member was satisfactory in photosensitive characteristics.

Further, the photosensitive member was 1.7 in optical energy gap (Egopt) and 3.5 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 36

The photosensitive member was prepared by the same manner as in Example 35 except that 2,2,3,3-tetrafluoropropylmethacrylate, i.e. $CH_2{=}C(CH_3)COOCH_2(CF_2)_2H$ was introduced instead of 2,2,2-trifluoroethylmethacrylate and the temperature of the third heater 724 was set to 50° C.

When subjected to CHN quantitative analysis, the a-C layer thus obtained was found to contain 34 atomic % of hydrogen atoms based on the combined amount of carbon atoms and hydrogen atoms. Further, when subjected to auger electron spectroscopy, the a-C layer thus obtained was found to contain 15 atomic % of halogen atoms, i.e. fluorine atoms and 4.8 atomic % of oxygen atoms based on all the constituent atoms therein. Moreover, the thickness of the member was 20 microns.

Characteristics:

When the photosensitive member obtained was used for the usual Carlson process, the member showed a Vmax of −550 V. Specifically, the C.A. of the member was 27 V by calculating from the entire thickness of the member, i.e. 20.4 microns, indicating that the member had satisfactory charging properties.

Further, the Td of the member was about 15 seconds, showing that the member had satisfactory charge retentivity.

The E of the member was about 2.9 lux-sec, showing that the member was satisfactory in photosensitive characteristics.

The Td′ of the member was about 8 seconds. Although the member exhibited slight reduction of charge retentivity, it was usable without any problem.

Further, the photosensitive member was 1.6 in optical energy gap (Egopt) and 3.6 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 37

The photosensitive member was prepared by the same manner as in Example 35 except that 1H,1H,5H-octafluoropentylmethacrylate, i.e. $CH_2{=}C(CH_3)COOCH_2(CF_2)_4H$ was introduced instead of 2,2,2-trifluoroethylmethacrylate and the temperature of the third heater 724 was set to 60° C.

When subjected to CHN quantitative analysis, the a-C layer thus obtained was found to contain 30 atomic % of hydrogen atoms based on the combined amount of carbon atoms and hydrogen atoms. Further, when subjected to auger electron spectroscopy, the a-C layer thus obtained was found to contain 25 atomic % of halogen atoms, i.e. fluorine atoms and 3.7 atomic % of oxygen atoms based on all the constituent atoms therein. Moreover, the thickness of the member was 25 microns.

The ratios of $\alpha_1$ to $\alpha_2$ and $\alpha_3$ to $\alpha_4$ were measured by the infrared absorption spectrum within the range of 4000 $cm^{-1}$ to 450 $cm^{-1}$ using an Infrared Fourier Transform Spectrometer 1710 (made by Perkin-Elmer Co., Ltd.). The obtained ratio of $\alpha_1$ to $\alpha_2$ was about 0.95 and $\alpha_3$ to $\alpha_4$ was about 0.8.

Characteristics:

When the photosensitive member obtained was used for the usual Carlson process, the member showed a Vmax of −450 V. Specifically, the C.A. of the member was 22.1 V by calculating from the entire thickness of the member, i.e. 25.4 microns. Although the member was slightly lower in charging ability than those of Examples 35 and 36, it was understood that the member was usable without any problem.

Further, the Td of the member was about 6 seconds. Although this value was slightly lower than that of Example 35, it was understood that tee member had satisfactory charge retentivity.

The E of the member was about 3.5 lux-sec, showing that the member was satisfactory in photosensitive characteristics.

Further, the photosensitive member was 1.5 in optical energy gap (Egopt) and 3.8 in relative dielectric constant.

The Td′ of the member was about 3 seconds. Although the member showed a reduction in charge retentivity, it was understood that the member was usable without any problem.

These results indicate that the photosensitive member prepared in the present example according to the invention exhibits outstanding performance. When the member was used in the Carlson process for forming images thereon, followed by image transfer, sharp copy images were obtained.

COMPARATIVE EXAMPLE 7

The photosensitive member was prepared by the same manner as in Example 35 except that 1H,1H,2H,2H-heptafluorodesylmethacrylate, i.e. $CH_2{=}C(CH_3)COOCH_2(CF_2)_8H$ was introduced instead of 2,2,2-trifluoroethylmethacrylate and the temperature of the third heater 724 was set to 70° C.

The a-C layer thus obtained was partly separated and was poor in ability of film-forming. When only the part of the member where the layer was firmly formed was subjected to CHN quantitative analysis, the a-C layer thus obtained was found to contain 28 atomic % of hydrogen atoms based on the combined amount of carbon atoms and hydrogen atoms. Further, when subjected to auger electron spectroscopy, the a-C layer thus obtained was found to contain 28 atomic % of halogen atoms, i.e. fluorine atoms and 2.6 atomic % of oxygen atoms based on all the constituent atoms therein. Moreover, the thickness of the member was 27 microns.

Characteristics:

When the photosensitive member obtained was used for the usual Carlson process, the member showed a Vmax of −350 V. Specifically, the C.A. of the member was 12.8 V by calculating from the entire thickness of the member, i.e. 27.4 microns, indicating that the member was low in charging properties.

Further, the Td of the member was about 3 seconds, showing that the member was low in charge retentivity The E of the member was 3.9 lux-sec., showing that the member had satisfactory photosensitive characteristics.

However, the T′ of the member did not reach 1 second, indicating that the member exhibited much reduction of charge retentivity after lapse of time.

These results indicate that the member shown in Comparative Example 7 is not satisfactory in performance.

As apparent from these results, the member with an excess doping of fluorine atoms is not suitable for electrophotographic performance.

EXAMPLE 38

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. was used. First, the interior of the reactor 733 was evacuated to a high vacuum of about $10^{-6}$ torr, and the first, second and third regulator valves 707, 708 and 709 were thereafter opened to introduce hydrogen gas from the first tank 701 into the first flow controller 713, carbon dioxide gas from the second tank 702 into the second flow controller 714 and tetrafluoromethane gas from the third tank 703 into the third flow controller 715, each at an output pressure of 1.0 kg/cm$^2$. At the same time, the seventh regulator valve was opened and myrcene gas, heated at a temperature of 65° C. by the first heater 722 was introduced into the seventh flow controller 728 from the first container 719. The dials on the flow controllers were adjusted to supply the hydrogen gas at a flow rate of 40 sccm, the carbon dioxide gas at 30 sccm, the tetrafluoromethane gas at 10 sccm and the myrcene gas at 25 sccm to the reactor 733 through the main pipe 732 via the intermediate mixer 731. After the flows of the gases were stabilized, the internal pressure of the reactor 733 was adjusted to 0.5 torr by the pressure control valve 745. On the other hand, the substrate 752, which was an aluminum substrate measuring 50 mm in length, 50 mm in width and 3 mm in thickness, was preheated to 150° C. With the gas flow rates and the pressure in stabilized state, 100-watt power with a frequency of 13.56 MHz was applied to the power application electrode 736 from the high-frequency power source 739 preconnected thereto by the selecting switch 744 to conduct plasma polymerization for 1 hour, forming an a-C layer, 15 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 40 atomic % of hydrogen atoms based on the combined amount of carbon atoms and hydrogen atoms. Further, when subjected to auger electron spectroscopy, the a-C layer thus obtained was found to contain 1.7 atomic % of halogen atoms, i.e. fluorine atoms, 1.2 atomic % of oxygen atoms based on all the constituent atoms therein.

Charge Generating Layer Forming Step (CGL):

Next, the first, fifth and sixth regulator valves 707, 711 and 712 were opened to introduce hydrogen gas from the first tank 701 into the first flow controller 713, diborane gas which was diluted to a concentration of 50 ppm with hydrogen gas into the fifth flow controller 717 from the fifth tank 705 and silane gas from the sixth tank 706 into the sixth flow controller 718, each at an output pressure of 1.0 kg/cm$^2$. The dials on the flow controllers were adjusted to supply the hydrogen gas at a flow rate of 200 sccm, the diborane gas diluted to the concentration of 50 ppm with hydrogen gas at a flow rate of 10 sccm and the silane gas at 100 sccm to the reactor 733. After the flows of the gases stabilized, the internal pressure of the reactor 733 was adjusted to 1.0 torr by the pressure control valve 745. On the other hand, the substrate 752 formed with the a-C layer was preheated to 150° C. With the gas flow rates and the pressure in stabilized state, 200-watt power with a frequency of 13.56 MHz was applied to the power application electrode 736 from the high-frequency power source 739 to effect glow discharge for 15 minutes, whereby a charge generating a-Si:H layer was formed with a thickness of 0.35 microns.

Characteristics:

When the photosensitive member obtained was used for the usual Carlson process, the member showed a Vmax of +650 V. Specifically, the C.A. of the member was 42.3 V by calculating from the entire thickness of the member, i.e. 15.35 microns, indicating that the member had satisfactory charging properties.

Further, the Td of the member was about 15 seconds, showing that the member had satisfactory charge retentivity.

The E of the member was about 2.1 lux-sec, showing that the member was satisfactory in photosensitive characteristics Further, the photosensitive member was 2.0 in optical energy gap (Egopt) and 3.1 in relative dielectric constant.

Moreover, it was understood that the member exhibited stabilized electrostatic characteristics over a prolonged period of time free of deterioration despite lapse of time.

These results indicate that the photosensitive member prepared in the present example according to the invention exhibits outstanding performance. When the member was used in the Carlson process for forming images thereon followed by image transfer, sharp copy images were obtained.

EXAMPLE 39

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

A charge transporting layer was formed on a substrate by the same method as Example 27.

Charge Generating Layer Forming Step (CGL):

The substrate having the charge transporting layer formed thereon by the CTL step was withdrawn from the apparatus, and then was placed into a vacuum evaporation apparatus, in which the layer was coated with $Se_3As_2$ alloy to a thickness of 0.5 microns by resistance heating.

Characteristics:

When the photosensitive member obtained was used for the usual Carlson process, the member showed a Vmax of +650 V. Specifically, the C.A. of the member was 35.1 V by calculating from the entire thickness of the member, i.e. 18.5 microns, indicating that the member had satisfactory charging properties.

Further, the Td of the member was about 15 seconds, showing that the member had satisfactory charge retentivity.

The E of the member was about 1.5 lux-sec, showing that the member was satisfactory in photosensitive characteristics.

Further, the photosensitive member was 1.9 in optical energy gap (Egopt) and 3.4 in relative dielectric constant.

Moreover, it was understood that the member exhibited stabilized electrostatic characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 40

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

A charge transporting layer was formed on a substrate by the same method as Example 27.

Charge Generating Layer Forming Step (CGL):

The substrate having the charge transporting layer formed thereon by the CTL step was withdrawn from the apparatus, and then was placed into a vacuum evaporation apparatus, in which the layer was coated with a vacuum evaporation film of copper phthalocyanine to a thickness of 0.5 microns by resistance heating with a high vacuum of about $10^{-5}$ torr and a boat temperature of about 600° C.

Characteristics:

When the photosensitive member obtained was used for the usual Carlson process, the member showed a Vmax of +650 V. Specifically, the C.A. of the member was 40.6 V by calculating from the entire thickness of the member, i.e. 16 microns, indicating that the member had satisfactory charging properties.

Further, the Td of the member was about 20 seconds, showing that the member had satisfactory charge retentivity The E of the member was about 6.7 lux-sec, showing that the member was satisfactory in photosensitive characteristics.

Further, the photosensitive member was 1.9 in optical energy gap (Egopt) and 3.4 in relative dielectric constant.

Moreover, it was understood that the member exhibited stabilized electrostatic characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 41

The photosensitive member shown in FIG. 2 was prepared by exactly the same process as in Example 28 except that the CTL step and CGL step in Example 28 were reversed in order.

Characteristics:

When the photosensitive member obtained was used for the usual Carlson process, the member showed a Vmax of +650 V. Specifically, the C.A. of the member was 40.6 V by calculating from the entire thickness of the member, i.e. 16 microns, indicating that the member had satisfactory charging properties.

The ratio of $\alpha_1$ to $\alpha_2$ was measured by the infrared absorption spectrum within the range of 4000 $cm^{-1}$ to 450 $cm^{-1}$ using an Infrared Fourier Transform Spectrometer 1710 (made by Perkin-Elmer Co., Ltd.). The obtained ratio of $\alpha_1$ to $\alpha_2$ was about 0.30.

Further, the Td of the member was about 15 seconds, showing that the member had satisfactory charge retentivity.

The E of the member was about 8.8 lux-sec, showing that the member was satisfactory in photosensitive characteristics.

Further, the photosensitive member was 2.1 in optical energy gap (Egopt) and 3.0 in relative dielectric constant.

Moreover, it was understood that the member exhibited stabilized electrostatic characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 42

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. 8 was used. First, the interior of the reactor 733 was evacuated to a high vacuum of about $10^{-6}$ torr, and the first, second, third and fourth regulator valves 707, 708, 709 and 710 were thereafter opened to introduce hydrogen gas from the first tank 701 into the first flow controller 713, carbon dioxide gas from the second tank 702 into the second flow controller 714, tetrafluoromethane gas from the third tank 703 into the third flow controller 715 and butadiene gas from the fourth tank 704 into the fourth flow controller 716, each at an output pressure of 1.0 kg/$cm^2$. At the same time, the seventh regulator valve 725 was opened, and stylene gas, heated at a temperature of 60° C. by the first heater 722 was introduced into the seventh flow controller 728 from the first container 719. The dials on the flow controllers were adjusted to supply the hydrogen gas at a flow rate of 40 sccm, the carbon dioxide gas at 30 sccm, tetrafluoromethane gas at 10 sccm, butadiene gas at 60 sccm and the stylene gas at 40 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, which was an aluminum substrate having a diameter of 80 mm and a length of 330 mm, was preheated to 150° C. With the gas flow rates and the pressure in stabilized state, 200-watt power with a frequency of 13.56 MHz was applied to the power application electrode 736 from the high-frequency power source 739 which was connected to the electrode by the connection selecting switch 744 in advance to conduct plasma polymerization for 1.5 hours, forming an a-C layer, 19 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 42 atomic % of hydrogen atoms based on the combined amount of carbon atoms and hydrogen atoms. Further, when subjected to auger electron spectroscopy, the a-C layer thus obtained was found to contain 1.2 atomic % of halogen atoms, i.e. fluorine atoms and 1.4 atomic % of oxygen atoms based on all the constituent atoms therein.

The ratios of $\alpha_1$ to $\alpha_2$ and $\alpha_3$ to $\alpha_4$ were measured by the infrared absorption spectrum within the range of 4000 $cm^{-1}$ to 450 $cm^{-1}$ using an Infrared Fourier Transform Spectrometer 1710 (made by Perkin-Elmer Co., Ltd.). The obtained ratio of $\alpha_1$ to $\alpha_2$ was about 0.48 and $\alpha_3$ to $\alpha_4$ was about 0.71.

Charge Generating Layer Forming Step (CGL):

Next, the first, fifth and sixth regulator valves 707, 711 and 712 were opened to introduce hydrogen gas from the first tank 701 into the first flow controller 713, diborane gas which was diluted to a concentration of 50 ppm with hydrogen gas into the fifth flow controller 717 from the fifth tank 705 and silane gas from the sixth tank 706 into the sixth flow controller 718, each at an output pressure of 1.0 $kg/cm^2$. The dials on the flow controllers were adjusted to supply the hydrogen gas at a flow rate of 300 sccm, the diborane gas diluted to the concentration of 50 ppm with hydrogen gas at a flow rate of 15 sccm and the silane gas at 180 sccm to the reactor 733. After the flows of the gases stabilized, the internal pressure of the reactor 733 was adjusted to 1.0 torr by the pressure control valve 745. On the other hand, the substrate 752 formed with the a-C layer was preheated to 150° C. With the gas flow rates and the pressure in stabilized state, 200-watt power with a frequency of 13.56 MHz was applied to the power application electrode 736 from the high-frequency power source 739 to effect glow discharge for 15 minutes, whereby a charge generating a-Si:H layer was formed with a thickness of 0.4 microns.

Characteristics:

When the photosensitive member obtained was used for the usual Carlson process, the member showed a Vmax of +750 V. Specifically, the C.A. of the member was 38.7 V by calculating from the entire thickness of the member, i.e. 19.4 microns, indicating that the member had satisfactory charging properties.

Further, the Td of the member was about 20 seconds, showing that the member had satisfactory charge retentivity.

The E of the member was about 2.4 lux-sec, showing that the member was satisfactory in photosensitive characteristics.

Further, the photosensitive member was 2.3 in optical energy gap (Egopt) and 3.0 in relative dielectric constant.

Moreover, it was understood that the member exhibited stabilized electrostatic characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 43

The photosensitive member was prepared by the same manner as in Example 35 except that chloroform gas was introduced instead of 2,2,2-trifluoroethylmethacrylate and the temperature of the third heater 724 was set to 15° C.

When subjected to CHN quantitative analysis, the a-C layer thus obtained was found to contain 41 atomic % of hydrogen atoms based on the combined amount of carbon atoms and hydrogen atoms. Further, when subjected to auger electron spectroscopy, the a-C layer thus obtained was found to contain 3.4 atomic % of halogen atoms, i.e. fluorine atoms and 4.8 atomic % of oxygen atoms based on all the constituent atoms therein. Moreover, the thickness of the member was 16 microns.

Characteristics:

When the photosensitive member obtained was used for the usual Carlson process, the member showed a Vmax of −750 V. Specifically, the C.A. of the member was 45.7 V by calculating from the entire thickness of the member, i.e. 16.4 microns, indicating that the member had satisfactory charging properties.

Further, the Td of the member was about 15 seconds, showing that the member had satisfactory charge retentivity The E of the member was about 2.8 lux-sec, showing that the member was satisfactory in photosensitive characteristics.

Further, the photosensitive member was 2.5 in optical energy gap (Egopt) and 3.3 in relative dielectric constant Moreover, it was understood that the member exhibited stabilized electrostatic characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 44

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. 7 was used. First, the interior of the reactor 733 was evacuated to a high vacuum of about $10^{-6}$ torr, and the first, second, third and fourth regulator valves 707, 708, 709 and 710 were thereafter opened to introduce hydrogen gas from the first tank 701 into the first flow controller 713, carbon dioxide gas from the second tank 702 into the second flow controller 714, tetrafluoromethane gas from the third tank 703 into the third flow controller 715 and diborane gas which was diluted to a concentration of 5% with hydrogen from the fourth tank 704 into the fourth flow controller 716, each at an output pressure of 1.0 $kg/cm^2$. At the same time, the seventh regulator valve was opened and myrcene gas, heated at a temperature of 65° C. by the first heater 722 was introduced into the seventh flow controller 728 from the first container 719. The dials on the flow controllers were adjusted to supply the hydrogen gas at a flow rate of 40 sccm, the carbon dioxide gas at 30 sccm, the tetrafluoromethane gas at 10 sccm, the myrcene gas at 25 sccm and diborane gas which was diluted to the concentration of 5% with hydrogen at 20 sccm to the reactor 733 through the main pipe 732 via the intermediate mixer 731. After the flows of the gases were stabilized, the internal pressure of the reactor 733 was adjusted to 0.5 torr by the pressure control valve 745. On the other hand, the substrate 752, which was an aluminum substrate measuring 50 mm in length, 50 mm in width and 3 mm in thickness, was preheated to 150° C. With the gas flow rates and the pressure in stabilized state, 100-watt power with a frequency of 13.56 MHz was applied to the power application electrode 736 from the high-frequency power source 739 preconnected thereto by the selecting switch 744 to conduct plasma polymerization for 1 hour, forming an a-C layer, 15 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 40 atomic % of hydrogen atoms based on the combined amount of carbon atoms and hydrogen atoms. Further, when subjected to auger electron spectroscopy, the a-C layer thus obtained was found to contain 1.7 atomic % of halogen atoms, i.e. fluorine atoms, 1.2 atomic % of oxygen atoms and 1.9 atomic % of diborane atoms based on all the constituent atoms therein.

CGL (a-Si) Step:

The a-Si:H charge generating layer having a thickness of 0.35 microns was subsequently formed by the same method as in Example 38.

Characteristics:

When the photosensitive member obtained was used for the usual Carlson process, the member showed a Vmax of +650 V. Specifically, the C.A. of the member was 42.3 V by calculating from the entire thickness of the member, i.e. 15.35 microns, indicating that the member had satisfactory charging properties.

Further, the Td of the member was about 13 seconds, showing that the member had satisfactory charge retentivity.

The E of the member was about 1.7 lux-sec, showing that the member was satisfactory in photosensitive characteristics.

Further, the photosensitive member was 2.0 in optical energy gap (Egopt) and 3.5 in relative dielectric constant.

Moreover, it was understood that the member exhibited stabilized electrostatic characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

As apparent from the above, the member exhibits improved photosensitivity by doping with Group IIIA elements of the Periodic Table.

EXAMPLE 45

The photosensitive member was prepared by the same method as in Example 26 except that ammonia gas was introduced at a flow rate of 40 sccm instead of nitrous oxide gas.

When subjected to CHN quantitative analysis, the a-C layer thus obtained was found to contain 42 atomic % of hydrogen atoms based on the combined amount of carbon atoms and hydrogen atoms. Further, when subjected to auger electron spectroscopy, the a-C layer thus obtained was found to contain 0.3 atomic % of halogen atoms, i.e. fluorine atoms and 3.9 atomic % of nitrogen atoms based on all the constituent atoms therein. Moreover, the thickness of the member was 18 microns.

Characteristics:

When the photosensitive member obtained was used for the usual Carlson process, the member showed a Vmax of −650 V. Specifically, the C.A. of the member was 36.1 V by calculating from the entire thickness of the member, i.e. 18.4 microns, indicating that the member had satisfactory charging properties.

Further, the Td of the member was about 20 seconds, showing that the member had satisfactory charge retentivity.

The E of the member was about 6.2 lux-sec and Vr was about −10 V, showing that the member was satisfactory in photosensitive characteristics.

Further, the photosensitive member was 2.4 in optical energy gap (Egopt) and 3.3 in relative dielectric constant.

Moreover, it was understood that the member exhibited stabilized electrostatic characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 46

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. 7 was used. First, the interior of the reactor 733 was evacuated to a high vacuum of about $10^{-6}$ torr, and the third and fourth regulator valves 709 and 710 were thereafter opened to introduce ammonia gas from the third tank 703 into the third flow controller 715 and argon gas from the fourth tank 704 into the fourth flow controller 716, each at an output ninth regulator valves 725 and 727 were opened and stylene gas, heated at a temperature of 60° C. by the first heater 722 was introduced into the seventh flow controller 728 from the first container 719 and 2,2,2-trifluoroethylmethacrylate, heated at a temperature of 40° C. by the third heater 724 was introduced into the ninth flow controller 730 from the third adjusted to supply the ammonia gas at a flow rate of 20 sccm, argon gas at a flow rate of 40 sccm, stylene gas at 40 sccm and the 2,2,2-trifluoroethylmethacrylate gas at a flow rate of 30 sccm to the reactor 733 through the main pipe 732 via the intermediate mixer 731. After the flows of the gases were stabilized, the internal pressure of the reactor 733 was adjusted to 0.5 torr by the pressure control valve 745. On the other hand, the substrate 752, which was an aluminum substrate measuring 50 mm in length, 50 mm in width and 3 mm in thickness, was preheated to 100° C. With the gas flow rates and the pressure in stabilized state, 150-watt power with a frequency of 40 KHz was applied to the power application electrode 736 from the low-frequency power source 741 preconnected thereto by the selecting switch 744 to conduct plasma polymerization for 1 hour, forming an a-C layer, 14 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 38 atomic % of hydrogen atoms based on the combined amount of carbon atoms and hydrogen atoms. Further, when subjected to auger electron spectroscopy, the a-C layer thus obtained was found to contain 10 atomic % of halogen atoms, i.e. fluorine atoms, 3.2 atomic % of nitrogen atoms and 4.1 atomic % of oxygen atoms based on all the constituent atoms therein.

CGL (a-Si) Step:

The a-Si:H charge generating layer having a thickness of 0.4 microns was subsequently formed by the same method as in Example 26.

Characteristics:

When the photosensitive member obtained was used for the usual Carlson process, the member showed a Vmax of −700 V. Specifically, the C.A. of the member was 48.6 V by calculating from the entire thickness of the member, i.e. 14.4 microns, indicating that the member had satisfactory charging properties.

Further, the Td of the member was about 15 seconds, showing that the member had satisfactory charge retentivity.

The E of the member was about 1.8 lux-sec and Vr was about −15 V, showing that the member was satisfactory in photosensitive characteristics.

Further, the photosensitive member was 1.9 in optical energy gap (Egopt) and 3.5 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 47

The photosensitive member was prepared by the same method as in Example 46 except-that 2,2,3,3-tetrafluoropropylmethacrylate, i.e. $CH_2{=}C(CH_3)COOCH_2(CF_2)_2H$ was introduced instead of 2,2,2-trifluoroethylmethacrylate and the temperature of the third heater 724 was set to 50° C.

When subjected to CHN quantitative analysis, the a-C layer thus obtained was found to contain 34 atomic % of hydrogen atoms based on the combined amount of carbon atoms and hydrogen atoms. Further, when subjected to auger electron spectroscopy, the a-C layer thus obtained was found to contain 15 atomic % of halogen atoms, i.e. fluorine atoms, 2.8 atomic % of nitrogen atoms and 3.3 atomic % of oxygen atoms based on all the constituent atoms therein. Moreover, the thickness of the member was 20 microns.

Characteristics:

When the photosensitive member obtained was used for the usual Carlson process, the member showed a Vmax of −550 V. Specifically, the C.A. of the member was 27 V by calculating from the entire thickness of the member, i.e. 20.4 microns, indicating that the member had satisfactory charging properties.

Further, the Td of the member was about 15 seconds, showing that the member had satisfactory charge retentivity.

The E of the member was about 2.9 lux-sec, showing that the member was satisfactory in photosensitive characteristics.

When the Td′ was measured, the photosensitive member shown in Example 46 indicated a value equal to that of T, whereas the present member showed about 8 minutes. Although the member exhibited a slight decrease in charge retentivity, it was usable without any problem.

Further, the photosensitive member was 3.6 in optical energy gap (Egopt) and 1.7 in relative dielectric constant.

These results indicate that the photosensitive member prepared in the present example according to the invention exhibits outstanding performance. When the member was used in the Carlson process for forming images thereon, followed by image transfer, sharp copy images were obtained.

EXAMPLE 48

The photosensitive member was prepared by the same manner as in Example 46 except that 1H,1H,5H-octafluoropentylmethacrylate, i.e. $CH_2{=}C(CH_3)COOCH_2(CF_2)_4H$ was introduced instead of 2,2,2-trifluoroethylmethacrylate and the temperature of the third heater 724 was set to 60° C.

When subjected to CHN quantitative analysis, the a-C layer thus obtained was found to contain 30 atomic % of hydrogen atoms based on the combined amount of carbon atoms and hydrogen atoms. Further, when subjected to auger electron spectroscopy, the a-C layer thus obtained was found to contain 25 atomic % of halogen atoms, i.e. fluorine atoms, 2.7 atomic % of nitrogen atoms and 2.4 atomic % of oxygen atoms based on all the constituent atoms therein. Moreover, the thickness of the member was 25 microns.

Characteristics:

When the photosensitive member obtained was used for the usual Carlson process, the member showed a Vmax of −450 V. Specifically, the C.A. of the member was 22.1 V by calculating from the entire thickness of the member, i.e. 25.4 microns. Although the member was slightly lower in charging ability than those of Examples 46 and 47, it was understood that the member was usable without any problem.

Further, the Td of the member was about 6 seconds. Although this value was slightly lower than that of Example 46, it was understood that the member had satisfactory charge retentivity.

The E of the member was about 3.5 lux-sec, showing that the member was satisfactory in photosensitive characteristics.

The T′ of the member was about 3 seconds. Although the member showed a decrease in charge retentivity, it was understood that the member was usable without any problem.

Further, the photosensitive member was 1.5 in optical energy gap (Egopt) and 3.8 in relative dielectric constant.

These results indicate that the photosensitive member prepared in the present example according to the invention exhibits outstanding performance. When the member was used in the Carlson process for forming images thereon, followed by image transfer, sharp copy images were obtained.

COMPARATIVE EXAMPLE 8

The photosensitive member was prepared by the same manner as in Example 46 except that 1H,1H,2H,2H-heptafluorodesylmethacrylate, i.e. $CH_2{=}C(CH_3)COOCH_2(CF_2)_8H$ was introduced instead of 2,2,2-trifluoroethylmethacrylate and the temperature of the third heater 724 was set to 70° C.

The a-C layer thus obtained was partly separated and was poor in ability of film-forming. When only the part of the member where the layer was firmly formed was subjected to CHN quantitative analysis, the a-C layer thus obtained was found to contain 28 atomic % of hydrogen atoms based on the combined amount of carbon atoms and hydrogen atoms. Further, when subjected to auger electron spectroscopy, the a-C layer thus obtained was found to contain 28 atomic % of halogen atoms, i.e. fluorine atoms, 2.0 atomic % of nitrogen atoms and 1.2 atomic % of oxygen atoms based on all the constituent atoms therein. Moreover, the thickness of the member was 27 microns.

Characteristics:

When the photosensitive member obtained was used for the usual Carlson process, the member showed a Vmax of −350 V. Specifically, the C.A. of the member was 12.8 V by calculating from the entire thickness of the member, i.e. 27.4 microns, indicating that the member was low in charging properties.

Further, the Td of the member was about 3 seconds, showing that the member was low in charge retentivity.

The E of the member was 3.9 lux-sec., showing that the member had satisfactory photosensitive characteristics.

However, the T′ of the member did not reach 1 second, indicating that the member exhibited much reduction of charge retentivity after lapse of time.

These results indicate that the member shown in Comparative Example 8 is not satisfactory in performance. Further, the member was very poor in ability for film-forming due to the excess amount of fluorine atoms.

EXAMPLE 49

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. 7 was used. First, the interior of the reactor 733 was evacuated to a high vacuum of about $10^{-6}$ torr, and the fourth regulator valve 710 was thereafter opened to introduce argon gas from the fourth tank 704 into the fourth flow controller 716 at an output pressure of 1.0 kg/cm$^2$. At the same time, the seventh, eighth and ninth regulator valves 725, 726 and 727 were opened and stylene, heated at 60° C. by the first heater 722 was introduced into the seventh flow controller 728 from the first container 719, aniline, heated at 95° C. by the second heater 723 was introduced into the eighth flow controller 729 from the second container 720 and 2,2,2-trifluoroethylmethacrylate, heated at a temperature of 40° C. by the third heater 724 was introduced into the ninth flow controller 730 from the third container 721. The dials on the flow controllers were adjusted to supply the argon gas at a flow rate of 40 sccm, stylene gas at 40 sccm, aniline gas at 40 sccm and the 2,2,2-trifluoroethylmethacrylate gas at 20 sccm to the reactor 733 through the main pipe 732 via the intermediate mixer 731. After the flows of the gases were stabilized, the internal pressure of the reactor 733 was adjusted to 0.8 torr by the pressure control valve 745. On the other hand, the substrate 752, which was an aluminum substrate measuring 50 mm in length, 50 mm in width and 3 mm in thickness, was preheated to 100° C. With the gas flow rates and the pressure in stabilized state, 150-watt power with a frequency of 40 KHz was applied to the power application electrode 736 from the low-frequency power source 741 preconnected thereto by the selecting switch 744 to conduct plasma polymerization for 1 hour, forming an a-C layer, 14 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 37 atomic % of hydrogen atoms based on the combined amount of carbon atoms and hydrogen atoms. Further, when subjected to auger electron spectroscopy, the a-C layer thus obtained was found to contain 9.6 atomic % of halogen atoms, i.e. fluorine atoms, 5.0 atomic of nitrogen atoms and 3.1 atomic % of oxygen atoms based on all the constituent atoms therein.

CGL (a-Si) Step:

The a-Si:H charge generating layer having a thickness of 0.4 microns was subsequently formed by the same method as in Example 26 except that the substrate was preheated to 100° C.

Characteristics:

When the photosensitive member obtained was used for the usual Carlson process, the member showed a Vmax of −750 V. Specifically, the C.A. of the member was 52.1 V by calculating from the entire thickness of the member, i.e. 14.4 microns, indicating that the member had satisfactory charging properties.

Further, the Td of the member was about 20 seconds, showing that the member had satisfactory charge retentivity.

The E of the member was about 13.5 lux-sec and Vr was about −25 V. Although the member was slightly low in photosensitive characteristics, it was understood that the member was usable without any problem.

The E′ and Vr′ were 18 lux-sec. and −35 V respectively.

Further, the photosensitive member was 2.2 in optical energy gap (Egopt) and 3.1 in relative dielectric constant.

These results indicate that the photosensitive member prepared in the present example according to the invention exhibits outstanding performance. When the member was used in the Carlson process for forming images thereon, followed by image transfer, sharp copy images were obtained.

COMPARATIVE EXAMPLE 9

The photosensitive member was prepared by exactly the same process as in Example 49 except that the flow rate of aniline gas was set to 80 sccm.

When subjected to CHN quantitative analysis, the a-C layer thus obtained was found to contain 34 atomic % of hydrogen atoms based on the combined amount of carbon atoms and hydrogen atoms. Further, when subjected to auger electron spectroscopy, the a-C layer thus obtained was found to contain 7.7 atomic % of halogen atoms, i.e. fluorine atoms, 7.2 atomic of nitrogen atoms and 2.9 atomic % of oxygen atoms based on all the constituent atoms therein. Moreover, the thickness of the a-C layer was 19 microns.

Characteristics:

When the photosensitive member obtained was used for the usual Carlson process, the member showed a Vmax of −800 V. Specifically, the C.A. of the member was 41.2 V by calculating from the entire thickness of the member, i.e. 19.4 microns, indicating that the member had satisfactory charging properties.

Further, the Td of the member was about 30 seconds, showing that the member had satisfactory charge retentivity.

However, the E of the member was about 22 lux-sec and Vr was −50 V. This shows that the member was low in sensitivity.

The E' of the member was not obtained because the member did not attain a half-reduced potential toward light in an amount of 80 lux-sec.

These results indicate that the member shown in Comparative Example 9 is not satisfactory in performance.

EXAMPLE 50

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. 7 was used. First, the interior of the reactor 733 was evacuated to a high vacuum of about $10^{-6}$ torr, and the first, second and third regulator valves 707, 708 and 709 were thereafter opened to introduce hydrogen gas from the first tank 701 into the first flow controller 713, nitrogen gas from the second tank 702 into the second flow controller 714 and tetrafluoromethane gas from the third tank 703 into the third flow controller 715, each at an output pressure of 1.0 kg/cm$^2$. At the same time, the seventh regulator valve 725 was opened and myrcene, heated at a temperature of 65° C. by the first heater 722 was introduced into the seventh flow controller 728 from the first container 719. The dials on the flow controllers were adjusted to supply the hydrogen gas at a flow rate of 40 sccm, nitrogen gas at 20 sccm, the tetrafluoromethane gas at 10 sccm and the myrcene gas at 25 sccm to the reactor 733 through the main pipe 732 via the intermediate mixer 731. After the flows of the gases were stabilized, the internal pressure of the reactor 733 was adjusted to 0.7 torr by the pressure control valve 745. On the other hand, the substrate 752, which was an aluminum substrate measuring 50 mm in length, 50 mm in width and 3 mm in thickness, was preheated to 150° C. With the gas flow rates and the pressure in stabilized state, 100-watt power with a frequency of 13.56 MHz was applied to the power application electrode 736 from the high-frequency power source 739 preconnected thereto by the selecting switch 744 to conduct plasma polymerization for 1 hour, forming an a-C layer, 15 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 40 atomic % of hydrogen atoms based on the combined amount of carbon atoms and hydrogen atoms. Further, when subjected to auger electron spectroscopy, the a-C layer thus obtained was found to contain 1.7 atomic % of halogen atoms, i.e. fluorine atoms, 0.5 atomic % of nitrogen atoms based on all the constituent atoms therein.

CGL (a-Si) Step:

The a-Si:H charge generating layer having a thickness of 0.35 microns was subsequently formed by the same method as in Example 38.

Characteristics:

When the photosensitive member obtained was used for the usual Carlson process, the member showed a Vmax of +650 V Specifically, the C.A. of the member was 42.3 V by calculating from the entire thickness of the member, i.e. 15.35 microns, indicating that the member had satisfactory charging properties.

Further, the Td of the member was about 15 seconds, showing that the member had satisfactory charge retentivity.

The E of the member was about 2.1 lux-sec, showing that the member was satisfactory in photosensitive characteristics.

Further, the photosensitive member was 2.3 in optical energy gap (Egopt) and 3.3 in relative dielectric constant Moreover, the member of the present example exhibited stabilized electrostatic characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 51

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. 8 was used. First, the interior of the reactor 733 was evacuated to a high vacuum of about $10^{-6}$ torr, and the first, second, third and fourth regulator valves 707, 708, 709 and 710 were thereafter opened to introduce hydrogen gas from the first tank 701 into the first flow controller 713, ammonia gas from the second tank 702 into the second flow controller 714, tetrafluoromethane gas from the third tank 703 into the third flow controller 715 and butadiene gas from the fourth tank 704 into the fourth flow controller 716, each at an output pressure of 1.0 kg/cm$^2$. At the same time, the seventh regulator valve 725 was opened, and stylene gas, heated at a temperature of 60° C. by the first heater 722 was introduced into the seventh flow controller 728 from the first container 719. The dials on the flow controllers were adjusted to supply the hydrogen gas at a flow rate of 40 sccm, the ammonia gas at 40 sccm, tetrafluoromethane gas at 10 sccm, butadiene gas at 60 sccm and the stylene gas at 40 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, which was an aluminum substrate having a diameter of 80 mm and a length of 330 mm, was preheated to 150° C. With the gas flow rates and the pressure in stabilized state, 200-watt power with a frequency of 13.56 MHz was applied to the power application electrode 736 from the high-frequency power source 739 which was connected to the electrode by the connection selecting switch 744 in advance to conduct plasma polymerization for 1.5 hours, forming an a-C layer, 19 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 42 atomic % of hydrogen atoms based on the combined amount of carbon atoms and hydrogen atoms. Further, when subjected to auger electron spectroscopy, the a-C layer thus obtained was found to contain 1.2 atomic % of halogen atoms, i.e. fluorine atoms and 1.2 atomic % of nitrogen atoms based on all the constituent atoms therein.

Charge Generating Layer Forming Step (CGL):

Next, the first, fifth and sixth regulator valves 707, 711 and 712 were opened to introduce hydrogen gas from the first tank 701 into the first flow controller 713, diborane gas which was diluted to a concentration of 50 ppm with hydrogen gas into the fifth flow controller 717 from the fifth tank 705 and silane gas from the sixth tank 706 into the sixth flow controller 718, each at an output pressure of 1.0 kg/cm$^2$. The dials on the flow controllers were adjusted to supply the hydrogen gas at a flow rate of 300 sccm, the diborane gas diluted to the concentration of 50 ppm with hydrogen gas at a flow rate of 15 sccm and the silane gas at 180 sccm to the reactor 733. After the flows of the gases stabilized, the internal pressure of the reactor 733 was adjusted to 1.0 torr by the pressure control valve 745. On the other hand, the substrate 752 formed with the a-C layer was preheated to 150° C. With the gas flow rates and the pressure in stabilized state, 200-watt power with a frequency of 13.56 MHz was applied to the power application electrode 736 from the high-frequency power source 739 to effect glow discharge for 15 minutes, whereby a charge generating a-Si:H layer was formed with a thickness of 0.4 microns.

Characteristics:

When the photosensitive member obtained was used for the usual Carlson process, the member showed a Vmax of +750 V. Specifically, the C.A. of the member was 38.7 V by calculating from the entire thickness of the member, i.e. 19.4 microns, indicating that the member had satisfactory charging properties.

Further, the Td of the member was about 20 seconds, showing that the member had satisfactory charge retentivity.

The E of the member was about 2.4 lux-sec, showing that the member was satisfactory in photosensitive characteristics.

Further, the photosensitive member was 2.5 in optical energy gap (Egopt) and 3.0 in relative dielectric constant.

Moreover, it was understood that the member exhibited stabilized electrostatic characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 52

The photosensitive member was prepared by the same manner as in Example 46 except that chloroform gas was introduced instead of 2,2,2-trifluoroethylmethacrylate and the temperature of the third heater 724 was set to 15° C.

When subjected to CHN quantitative analysis, the a-C layer thus obtained was found to contain 41 atomic % of hydrogen atoms based on the combined amount of carbon atoms and hydrogen atoms. Further, when subjected to auger electron spectroscopy, the a-C layer thus obtained was found to contain 3.5 atomic % of halogen atoms, i.e. fluorine atoms and 3.1 atomic % of nitrogen atoms based on all the constituent atoms therein. Moreover, the thickness of the member was 16 microns.

Characteristics:

When the photosensitive member obtained was used for the usual Carlson process, the member showed a Vmax of −750 V. Specifically, the C.A. of the member was 45.7 V by calculating from the entire thickness of the member, i.e. 16.4 microns, indicating that the member had satisfactory charging properties.

Further, the Td of the member was about 15 seconds, showing that the member had satisfactory charge retentivity.

The E of the member was about 2.8 lux-sec, showing that the member was satisfactory in photosensitive characteristics.

Further, the photosensitive member was 2.6 in optical energy gap (Egopt) and 3.1 in relative dielectric constant.

Moreover, it was understood that the member exhibited stabilized electrostatic characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 53

Using an apparatus for practicing the present invention, a photosensitive member was prepared, the member comprising an electrically conductive substrate, a charge generating layer and a charge transporting layer provided in this order as shown in FIG. 2.

CGL (a-Si) Step:

A photosensitive layer comprising Se-As alloy and having a thickness of about 3 microns was formed on a substrate 752, which was an aluminum substrate having a diameter of 80 mm and a length of 330 mm, with a vacuum evaporation apparatus.

Charge Transporting Layer Forming Step (CTL):

The glow discharge decomposition apparatus shown in FIG. 8 was used. First, the interior of the reactor 733 was evacuated to a high vacuum of about $10^{-6}$ torr, and the first, second, third and fourth regulator valves 707, 708, 709 and 710 were thereafter opened to introduce hydrogen gas from the first tank 701 into the first flow controller 713, propylene gas from the second tank 702 into the second flow controller 714, tetrafluoromethane gas from the third tank 703 into the third flow controller 715 and nitrous oxide gas from the fourth tank 704 into the fourth flow controller 716, each at an output pressure of 1.0 kg/cm$^2$. The dials on the flow controllers were adjusted to supply the hydrogen gas at a flow rate of 40 sccm, the propylene gas at 40 sccm, tetrafluoromethane gas at 120 sccm and the nitrous oxide gas at 40 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, on which the Se-As charge generating layer was formed, was preheated to 55° C. With the gas flow rates and the pressure in stabilized state, 200-watt power with a frequency of 13.56 MHz was applied to the power application electrode 736 from the high-frequency power source 739 which was connected to the electrode by the connection selecting switch 744 in advance to conduct plasma polymerization for 4 hours, forming an a-C layer, 20 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 47 atomic % of hydrogen atoms based on the combined amount of carbon atoms and hydrogen atoms. Further, when subjected to auger electron spectroscopy, the a-C layer thus obtained was found to contain 3.3 atomic % of halogen atoms, i.e. fluorine atoms, 1.2 atomic % of nitrogen atoms and 1.4 atomic % of oxygen atoms based on all the constituent atoms therein.

Characteristics:

When the photosensitive member obtained was used for the usual Carlson process, the member showed a Vmax of −600 V. Specifically, the C.A. of the member was 26.1 V by calculating from the entire thickness of the member, i.e. 23 microns, indicating that the member had satisfactory charging properties.

Further, the Td of the member was about 13 seconds, showing that the member had satisfactory charge retentivity.

The E of the member was about 3.1 lux-sec and Vr was about −20 V, showing that the member was satisfactory in photosensitive characteristics.

Further, the photosensitive member was 2.0 in optical energy gap (Egopt) and 3.5 in relative dielectric constant.

Moreover, Vmax', Td' and E' of the member were −580 V, 14 seconds and 3.0 lux-sec. respectively. These results showed that the member exhibited stabilized electrostatic characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 54

Using an apparatus for practicing the present invention, a photosensitive member was prepared, the member comprising an electrically conductive substrate, a charge generating layer and a charge transporting layer provided in this order as shown in FIG. 2.

CGL (a-Si) Step:

The vacuum evaporation apparatus(not shown) was used. First, the interior of the apparatus was evacuated to a vacuum of about less than $10^{-5}$ Torr, and AlClPc(Cl) was evaporated on a substrate, which was an aluminum substrate measuring 50 mm in length, 50 mm in width and 3 mm in thickness, under a boat temperature of about 400° to 500° C. for five minutes to form an AlClPc(Cl) charge generating layer in a thickness of about 400 angstrom.

Charge Transporting Layer Forming Step (CTL):

The glow discharge decomposition apparatus shown in FIG. 7 was used. First, the interior of the reactor 733 was evacuated to a high vacuum of about $10^{-6}$ torr, and the first, second, third and fourth regulator valves 707, 708, 709 and 710 were thereafter opened to introduce hydrogen gas from the first tank 701 into the first flow controller 713, propylene gas from the second tank 702 into the second flow controller 714, tetrafluoromethane gas from the third tank 703 into the third flow controller 715 and nitrous oxide gas from the fourth tank 704 into the fourth flow controller 716, each at an output pressure of 1.0 kg/cm$^2$. The dials on the flow controllers were adjusted to supply the hydrogen gas at a flow rate of 40 sccm, the propylene gas at 40 sccm, tetrafluoromethane gas at 120 sccm and the nitrous oxide gas at 40 sccm to the reactor 733 through the main pipe 732 via the intermediate mixer 731. After the flows of the gases were stabilized, the internal pressure of the reactor 733 was adjusted to 1.0 torr by the pressure control valve 745. On the other hand, the substrate 752, on which the AlClPc(Cl) charge generating layer was formed, was preheated to 70° C. With the gas flow rates and the pressure in stabilized state, 200-watt power with a frequency of 13.56 MHz was applied to the power application electrode 736 from the high-frequency power source 739 which was connected to the electrode by the connection selecting switch 744 in advance to conduct plasma polymerization for 4 hours, forming an a-C layer, 20 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 47 atomic % of hydrogen atoms based on the combined amount of carbon atoms and hydrogen atoms. Further, when subjected to auger electron spectroscopy, the a-C layer thus obtained was found to contain 3.7 atomic % of halogen atoms, i.e. fluorine atoms, 1.2 atomic of nitrogen atoms and 1.5 atomic % of oxygen atoms based on all the constituent atoms therein.

Characteristics:

When the photosensitive member obtained was used for the usual Carlson process, the member showed a Vmax of −600 V. Specifically, the C.A. of the member was 30.0 V by calculating from the entire thickness of the member, i.e. 20 microns, indicating that the member had satisfactory charging properties.

Further, the Td of the member was about 13 seconds, showing that the member had satisfactory charge retentivity.

The E of the member was about 3.0 lux-sec and Vr was about −20 V, showing that the member was satisfactory in photosensitive characteristics.

Further, the photosensitive member was 2.0 in optical energy gap (Egopt) and 3.5 in relative dielectric constant.

Moreover, Vmax', Td', Vr' and E' of the member were −580 V, 13 seconds, −17 V and 2.8 lux-sec. respectively. These results showed that the member exhibited stabilized electrostatic characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 55

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The a-C charge transporting layer was formed on the substrate by the same manner as in Example 26.

Charge Generating Layer Forming Step (CGL):

Next, the first, fifth and sixth regulator valves 707, 711 and 712 were opened to introduce hydrogen gas from the first tank 701 into the first flow controller 713, phosphine gas which was diluted to a concentration of 50 ppm with hydrogen gas into the fifth flow controller 717 from the fifth tank 705 and silane gas from the sixth tank 706 into the sixth flow controller 718, each at an output pressure of 1.0 kg/cm$^2$. The dials on the flow controllers were adjusted to supply the hydrogen gas at a flow rate of 100 sccm, the phosphine gas diluted to the concentration of 50 ppm with hydrogen gas at a flow rate of 3 sccm and the silane gas at 60 sccm to the reactor 733. After the flows of the gases stabilized, the internal pressure of the reactor 733 was adjusted to 1.0 torr by the pressure control valve 745. On the other hand, the substrate 752 formed with the a-C layer was preheated to 200° C. With the gas flow rates and the pressure in stabilized state, 100-watt power with a frequency of 13.56 MHz was applied to the power application electrode 736 from the high-frequency power source 739 to effect glow discharge for 20 minutes, whereby a charge generating a-Si:H layer was formed with a thickness of 0.4 microns.

Characteristics:

When the photosensitive member obtained was used for the usual Carlson process, the member showed a Vmax of −600 V. Specifically, the C.A. of the member was 29.4 V by calculating from the entire thickness of the member, i.e. 20.4 microns, indicating that the member had satisfactory charging properties.

Further, the Td of the member was about 13 seconds, showing that the member had satisfactory charge retentivity.

The E of the member was about 1.7 lux-sec and Vr was about −13 V, showing that the member was satisfactory in photosensitive characteristics.

Further, the photosensitive member was 1.8 in optical energy gap (Egopt) and 3.6 in relative dielectric constant.

Moreover, Vmax', Td', Vr' and E' of the member were −580 V, 13 seconds, −11 V and 1.6 lux-sec. respectively. These results showed that the member exhibited stabilized electrostatic characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

EXAMPLE 56

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. 7 was used. First, the interior of the reactor 733 was evacuated to a high vacuum of about $10^{-6}$ torr, and the first, second, third, fourth and fifth regulator valves 707, 708, 709, 710 and 711 were thereafter opened to introduce hydrogen gas from the first tank 701 into the first flow controller 713, acetylene gas from the second tank 702 into the second flow controller 714, tetrafluoromethane gas from the third tank 703 into the third flow controller 715, nitrous oxide gas from the fourth tank 704 into the fourth flow controller 716 and phosphine gas which was diluted to a concentration of 10% with hydrogen from the fifth tank 705 into the fifth flow controller 717, each at an output pressure of 1.0 kg/cm$^2$. The dials on the flow controllers were adjusted to supply the hydrogen gas at a flow rate of 40 sccm, the acetylene gas at 40 sccm, the tetrafluoromethane gas at 120 sccm, the nitrous oxide gas at 40 sccm and phosphine gas which was diluted to the concentration of 5% with hydrogen at 20 sccm to the reactor 733 through the main pipe 732 via the intermediate mixer 731. After the flows of the gases were stabilized, the internal pressure of the reactor 733 was adjusted to 1.0 torr substrate 752, which was an aluminum substrate measuring 50 mm in length, 50 mm in width and 3 mm in thickness, was preheated to 200° C. With the gas flow rates and the pressure in stabilized state, 200-watt power with a frequency of 13.56 MHz was applied to the power application electrode 736 from the high-frequency power source 739 preconnected thereto by the selecting switch 744 to conduct plasma polymerization for 5 hours, forming an a-C layer, 20 microns in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 44 atomic % of hydrogen atoms based on the combined amount of carbon atoms and hydrogen atoms. Further, when subjected to auger electron spectroscopy, the a-C layer thus obtained was found to contain 4.1 atomic % of halogen atoms, i.e. fluorine atoms, 1.4 atomic % of oxygen atoms, 1.2 atomic % of nitrogen atoms and 2.0 atomic % of phosphine atoms based on all the constituent atoms therein.

The ratios of $\alpha_1$ to $\alpha_2$ and $\alpha_3$ to $\alpha_4$ were measured by the infrared absorption spectrum within the range of 4000 $cm^{-1}$ to 450 $cm^{-1}$ using an Infrared Fourier Transform Spectrometer 1710 (made by Perkin-Elmer Co., Ltd.). The obtained ratio of $\alpha_1$to $\alpha_2$ was about 0.65 and $\alpha_3$ to $\alpha_4$ was about 0.66.

CGL (a-Si) Step:

The a-Si H charge generating layer having a thickness of 0.4 microns was subsequently formed by the same method as in Example 26.

Characteristics:

When the photosensitive member obtained was used for the usual Carlson process, the member showed a Vmax of −600 V. Specifically, the C.A. of the member was 29.4 V by calculating from the entire thickness of the member, i.e. 20.4 microns, indicating that the member had satisfactory charging properties.

Further, the Td of the member was about 13 seconds, showing that the member had satisfactory charge retentivity.

The E of the member was about 1.6 lux-sec and Vr was about −11 V, showing that the member was satisfactory in photosensitive characteristics.

Further, the photosensitive member was 2.2 in optical energy gap (Egopt) and 3.2 in relative dielectric constant.

Moreover, The Vmax', Td', E' and Vr' of the member were −580 V, 13 seconds, 1.6 lux-sec. and −8 V respetively. These results showed that the member exhibited stabilized electrostatic characteristics over a prolonged period of time free of deterioration despite lapse of time.

These results indicate that the photosensitive member prepared in the present example according to the invention exhibits outstanding performance. When the member was used in the Carlson process for forming images thereon, followed by image transfer, sharp copy images were obtained.

As is apparent from the above, the member exhibits improved photosensitivity by doping with Group VA elements of the Periodic Table.

COMPARATIVE EXAMPLE 10

The photosensitive member was prepared by exactly the same process as in Example 26 except that the charge generating layer forming step was not performed. Therefore, the member comprises only the charge transporting layer on the substrate.

The amount of hydrogen, fluorine, oxygen and nitrogen and the value of Egopt and relative electric constant in the present a-C layer were the same as those in Example 26.

Characteristics:

When the photosensitive member obtained was used for the usual Carlson process, the member showed a Vmax of −600 V. Specifically, the C.A. of the member was 30 V by calculating from the entire thickness of the member, i.e. 20 microns, indicating that the member had satisfactory charging properties.

Further, the Td of the member was about 25 seconds, showing that the member had satisfactory charge retentivity.

However, the member, when exposed with white light, showed the decay characteristics equal to that in the dark decay. Therefore, the E and Vr could not be obtained.

Consequently, it was understood that the present a-C layer was non-photoconductive.

COMPARATIVE EXAMPLE 11 a-C Layer Forming Step:

The glow discharge decomposition apparatus shown in FIG. 8 was used. First, an aluminum drum measuring 330 mm in length and 80 mm in diameter was placed in the reactor chamber 733 which was evacuated to a high vacuum of about $10^{-4}$ Torr. Thereafter, the drum was rotated at 5 r.p.m., and perfluoropropane gas was introduced into the chamber at a flow rate of 100 sccm. After the flow of the gas was stabilized, the internal pressure of the reactor 733 was adjusted to 0.2 Torr by the pressure control valve 745. On the other hand, the substrate was preheated to 200° C. With the gas flow rate and the pressure in stabilized state, 300-watt power with a frequency of 13.56 MHz was applied to the power application electrode 736 from the high-frequency power source 739 which was connected to the electrode by the connection selecting switch 744 in advance to conduct plasma polymerization for 2 hours, forming an a-C:F layer, 6 microns in thickness.

When subjected to CHN quantitative analysis, the a-C:F layer thus obtained was found to contain no hydrogen atoms. C:F layer thus obtained was found to contain 24 atomic % of fluorine atoms.

Characteristics:

The photosensitive member was 1.7 in optical energy gap (Egopt) and 3.1 in relative dielectric constant.

The a-C:F layer was charged to 200 V with a corona charger, and then, exposed with light having various wavelengths of 400, 500, 600 and 800 nm with an intensity of 50 ergs/$cm^2$. When the light decay characteristics were compared with the dark decay characteristics, no differences were found. As a result, the a-C:F layer prepared in the present comparative example has no photoconductivity.

What is claimed is:

1. A photosensitive member comprising:

an electrically conductive substrate;

a charge generating layer; and a charge transporting layer comprising amorphous carbon containing hydrogen in an amount of about 0.1 to about 67 atomic % based on the combined amount of hydrogen and carbon, said charge transporting layer containing halogen in an amount of about 0.1 to about 25 atomic % based on all the constituent atoms in the layer and having relative dielectric constant of about 2.0 to about 6.0.

2. A photosensitive member as claimed in claim 1 wherein said charge transporting layer further contains about 0.1 to about 5 atomic % of nitrogen based on all the constituent atoms therein.

3. A photosensitive member as claimed in claim 1 wherein said charge transporting layer further contains about 0.1 to about 7 atomic % of oxygen based on all the constituent atoms therein.

4. A photosensitive member as claimed in claim 1 wherein said charge transporting layer has essentially no photoconductivity.

5. A photosensitive member as claimed in claim 1 wherein said charge transporting layer is prepared by organic plasma polymerization.

6. A photosensitive member comprising:

an electrically conductive substrate;

a charge generating layer; and a charge transporting layer comprising amorphous carbon containing hydrogen in an amount of about 0.1 to about 67 atomic % based on the combined amount of hydrogen and carbon, said charge transporting layer containing halogen in an amount of about 0.1 to about 25 atomic % and about 0.1 to about 5 atomic % of oxygen and/or about 0.1 to 7 atomic % of nitrogen based on all the constituent atoms in the layer, having relative dielectric constant of about 2.0 to about 6.0 and having essentially no photoconductivity.

7. A photosensitive member as claimed in claim 6 wherein the amount of the halogen contained in the charge transporting layer is preferably about 0.3 to about 15 atomic % based on all the constituent atoms therein.

8. A photosensitive member as claimed in claim 6 wherein the amount of the oxygen contained in the charge transporting layer is preferably about 0.1 to about 4.7 atomic % based on all the constituent atoms therein.

9. A photosensitive member as claimed in claim 6 wherein the amount of the nitrogen contained in the charge transporting layer is preferably about 0.1 to about 3.9 atomic % based on all the constituent atoms therein.

10. A photosensitive member as claimed in claim 6 wherein the charge transporting layer has an optical energy gap of about 1.5 to about 3.0.

* * * * *